US008597864B2

(12) United States Patent
Suzuki et al.

(10) Patent No.: US 8,597,864 B2
(45) Date of Patent: Dec. 3, 2013

(54) PHOTORECEPTOR FOR ELECTROPHOTOGRAPHY, PROCESS FOR PRODUCING THE SAME, AND ELECTROPHOTOGRAPHIC APPARATUS

(75) Inventors: Shinjiro Suzuki, Matsumoto (JP); Yoichi Nakamura, Matsumoto (JP); Seizo Kitagawa, Matsumoto (JP); Fengqiang Zhu, Matsumoto (JP); Kazuki Nebashi, Matsumoto (JP)

(73) Assignee: Fuji Electric Co., Ltd., Kawasaki-shi (JP)

( * ) Notice: Subject to any disclaimer, the term of this patent is extended or adjusted under 35 U.S.C. 154(b) by 67 days.

(21) Appl. No.: 13/148,438

(22) PCT Filed: Feb. 16, 2009

(86) PCT No.: PCT/JP2009/052576

§ 371 (c)(1), (2), (4) Date: Nov. 14, 2011

(87) PCT Pub. No.: WO2010/092695

PCT Pub. Date: Aug. 19, 2010

(65) Prior Publication Data

US 2012/0058422 A1 Mar. 8, 2012

(51) Int. Cl.
*G03G 5/00* (2006.01)

(52) U.S. Cl.
USPC ..... 430/96; 430/56; 430/59.6; 430/133; 399/159

(58) Field of Classification Search
USPC ..... 430/96, 56, 59.6, 133; 399/159
See application file for complete search history.

(56) References Cited

U.S. PATENT DOCUMENTS

| | | | |
|---|---|---|---|
| 2003/0077531 | A1 | 4/2003 | Suzuki et al. |
| 2005/0079431 | A1 | 4/2005 | Kobashi et al. |

FOREIGN PATENT DOCUMENTS

| | | | |
|---|---|---|---|
| CN | 1605944 | A | 4/2005 |
| JP | 61-062040 | A | 3/1986 |
| JP | 01-205171 | A | 8/1989 |
| JP | 04-368953 | A | 12/1992 |
| JP | 05-113670 | A | 5/1993 |
| JP | 07-333881 | A | 12/1995 |
| JP | 08-234468 | A | 9/1996 |
| JP | 2002-012657 | A | 1/2002 |
| JP | 2002-128883 | A | 5/2002 |
| JP | 2002-162759 | A | 6/2002 |
| JP | 2002-214807 | A | 7/2002 |
| JP | 2002-333730 | A | 11/2002 |
| JP | 2002-351113 | A | 12/2002 |
| JP | 2004-093865 | A | 3/2004 |
| JP | 2004-219922 | A | 8/2004 |
| JP | 2004-323727 | A | 11/2004 |
| JP | 2005-115091 | A | 4/2005 |
| JP | 2006-078533 | A | 3/2006 |
| JP | 2007-199659 | A | 8/2007 |
| JP | 2009-013275 | A | 1/2009 |
| JP | 2009-019289 | A | 1/2009 |

*Primary Examiner* — Mark A Chapman
(74) *Attorney, Agent, or Firm* — Rabin & Berdo, P.C.

(57) ABSTRACT

Provided is a photoreceptor for electrophotography, a process for producing the photoreceptor, and an electrophotographic apparatus that includes the photoreceptor. The photoreceptor has a photosensitive layer which contains a resin binder that is a copolymerized polyallylate resin. An electrophotographic apparatus having a photoreceptor drum that includes this photoreceptor has a reduced surface frictional resistance throughout the printing period from the beginning to after printing, thus reducing the amount of surface wear while producing satisfactory images.

24 Claims, 4 Drawing Sheets

PHOTORECEPTOR FOR ELECTROPHOTOGRAPHY, PROCESS FOR PRODUCING THE SAME, AND ELECTROPHOTOGRAPHIC APPARATUS

TECHNICAL FIELD

The present invention relates to a photoreceptor for electrophotography (hereinafter, also referred to as "photoreceptor"), a process for producing the same, and an electrophotographic apparatus. More particularly, the invention relates to a photoreceptor for electrophotography which is composed mainly of an electrically conductive substrate and a photosensitive layer containing an organic material, and is used in printers, copying machines, facsimiles and the like of electrophotographic systems, a process for producing the photoreceptor, and an electrophotographic apparatus.

BACKGROUND ART

A photoreceptor for electrophotography has a structure in which a photosensitive layer having a photoconductive function on an electrically conductive substrate, as a fundamental structure. In recent years, research and development has been actively carried out on organic photoreceptors for electrophotography which use organic compounds as functional components responsible for the generation or transportation of charges, in view of advantages such as the diversity of materials, high productivity and safety, and application of the organic photoreceptors to copying machines, printers and the like is underway.

In general, photoreceptors are required to have a function of retaining surface charges in the dark, a function of receiving light and generating charges, and a function of transporting the generated charges, and photoreceptors are classified into so-called single layer type photoreceptors which have a single layer of photosensitive layer combining these functions; and so-called laminated type photoreceptors which include functionally separated layers such as a charge generation layer that is mainly in charge of a function of charge generation at the time of light reception, a charge transport layer that is in charge of a function of retaining surface charges in the dark and a function of transporting the charges generated at the charge generation layer at the time of light reception, and a photosensitive layer.

The photosensitive layer is generally formed by applying, on an electrically conductive substrate, a coating liquid prepared by dissolving or dispersing a charge generating material, a charge transport material and a resin binder in an organic solvent. In these organic photoreceptors for electrophotography, particularly in the layer that serves as the outermost surface, polycarbonate is often used as the resin binder because polycarbonate is strongly resistant to the friction that occurs between the layer and paper or a blade for toner removal, has excellent flexibility, and has good permeability of exposure light. Among others, bisphenol Z type polycarbonate is widely used as the resin binder. Technologies of using such a polycarbonate as a resin binder are described in Patent Document 1 and the like.

On the other hand, the mainstream of recent electrophotographic apparatuses is constituted of so-called digital instruments which use monochromatic light of argon, helium-neon, a semiconductor laser, a light emitting diode or the like as an exposure light source, and which are capable of digitalizing information such as images and characters to convert the information into light signals, irradiating an electrically charged photoreceptor with light to form an electrostatic latent image on the surface of the photoreceptor, and visualizing the latent image using toner.

Methods for electrically charging a photoreceptor include non-contact charging systems such as a scorotron, in which a charging member and a photoreceptor are not brought into contact; and contact charging systems using a roller or a brush, in which a charging member and a photoreceptor are brought into contact. Among these, the contact charging systems are characterized in that since corona discharge occurs in the proximity of the photoreceptor, less ozone is generated and the applied voltage may be lower as compared with the non-contact charging systems. Accordingly, the contact charging systems are more compact and are capable of realizing electrophotographic apparatuses at lower cost while causing less environmental contamination, and therefore, the contact charging systems constitute the mainstream particularly in medium-size and small-size apparatuses.

As the means for cleaning the photoreceptor surface, scraping off using a blade, a simultaneous development and cleaning process, and the like are mainly used. Cleaning using a blade involves scraping off untransferred residual toner on the surface of an organic photoreceptor using the blade, and may collect the toner into a waste toner box or return the toner into the development machine. Cleaners of such a scraping-off system using a blade require a collection box for recovered toner or a space for recycling, and the full-up of the toner collection box should be monitored. Furthermore, when paper dust or external additives remain on the blade, scratches may occur on the surface of the organic photoreceptor, causing shortening of the service life of the electrophotographic photoreceptor. Thus, there are occasions in which the toner is collected during the development process, or a process for magnetically or electrically suctioning any residual toner adhering to the surface of the electrophotographic photoreceptor is provided immediately before the development roller.

Furthermore, in the case of using a cleaning blade, it is necessary to enhance the rubber hardness or to increase the contact pressure in order to increase the cleaning properties. Therefore, abrasion of the photoreceptor is accelerated so that a fluctuation in the potential and a fluctuation in the sensitivity occur, image aberrance is caused, and flaws occur in the balance of color or reproducibility in color machines.

On the other hand, in the case of using the cleanerless mechanism by which simultaneous development and cleaning is carried out in a development apparatus using the contact charging mechanism, there occurs toner with a fluctuating amount of charging at a contact charging mechanism unit. Meanwhile, in the case where there is toner with reverse polarity which has been incorporated in a very small amount, there is a problem that this toner cannot be sufficiently removed from the surface of the photoreceptor and contaminates the charging apparatus.

Furthermore, the photoreceptor surface is also contaminated by ozone, nitrogen oxides and the like that are generated at the time of photoreceptor charging. There are problems such as image bleeding due to the contaminants themselves, a decrease in lubricity of the surface caused by adhering materials, easy adhesion of paper dust and toner, squealing of the blade, peeling, and the susceptibility of the surface to scratches.

Furthermore, in order to increase the toner transfer efficiency in the transfer process, attempts have been made to reduce residual toner through an increase in the transfer efficiency, by regulating the transfer current to be optimal in accordance with the temperature and humidity environment or the characteristics of paper. Furthermore, as an organic photoreceptor appropriate for such processes or contact charging systems, an organic photoreceptor having improved toner releasability, or an organic photoreceptor that is less affected by transfer, is required.

In order to solve these problems, methods for ameliorating the outermost surface layers of photoreceptors have been suggested. For example, Patent Document 2 and 3 suggest methods of adding filler to the surface layer of a photosensitive layer in order to enhance the durability of the photoreceptor surface. However, in a method of dispersing a filler in such a film, it is difficult to uniformly disperse the filler. Furthermore, as there occurs generation of filler aggregates, a decrease in the permeability of the film, or scattering of the exposure light by the filler, charge transport or charge generation is carried out non-uniformly, and image characteristics are deteriorated. Furthermore, methods of adding a dispersing material in order to enhance filler dispersibility may be mentioned, but since the dispersing material itself affects the characteristics of the photoreceptor, it is difficult to obtain a good balance between durability and filler dispersibility.

Furthermore, Patent Document 4 suggests a method of incorporating a fluororesin such as PTFE into the photosensitive layer. Patent Document 5 suggests a method of adding a silicone resin such as an alkyl-modified polysiloxane. However, in the method described in Patent Document 4, a fluororesin such as PTFE has low solubility in solvents and has poor compatibility with other resins, so that the fluororesin undergoes phase separation and causes light scattering at the resin surface. For that reason, the photosensitive layer does not satisfy the sensitivity characteristics required of a photoreceptor. Furthermore, the method described in Patent Document 5 has a problem that because the silicone resin bleeds into the coating surface, the effects cannot be obtained continually.

Thus, in order to solve such problems, Patent Document 6 suggests a method of enhancing wear resistance by using a resin having a siloxane structure added to the terminal structure. Furthermore, Patent Document 7 suggests a photoreceptor containing a polycarbonate or a polyallylate, both of which have been produced using a phenol compound having a specific siloxane structure, as a starting material. Patent Document 8 suggests a photoreceptor containing a resin in which a siloxane resin structure containing a carboxyl group has been introduced into the resin structure. Also, Patent Document 9 suggests a photosensitive layer containing a polycarbonate which has a silicone structure and has decrease surface energy. Patent Document 10 suggests a photoreceptor containing a polyester resin which includes a polysiloxane as a constituent unit, at the outermost surface layer of the photoreceptor.

Patent Document 11 suggests using a polyallylate as a resin binder of the photosensitive layer, and extensive investigations have been carried out for the purpose of an enhancement of durability or mechanical strength. Patent Document 12 suggests a photoreceptor which uses a phenol-modified polysiloxane resin as a siloxane component, and uses a polycarbonate or polyallylate resin having a siloxane structure in the photosensitive layer. Furthermore, Patent Document 13 suggests an electrophotographic apparatus which includes a photosensitive layer containing a silicone-modified polyallylate resin.

On the other hand, for the purposes of protecting the photosensitive layer, enhancing the mechanical strength, enhancing the surface lubricity, and the like, there have been suggested methods of forming a surface protective layer on the photosensitive layer. However, in these methods of forming a surface protective layer, there are problems that it is difficult to form a film as a charge transport layer, or it is difficult to achieve a sufficiently good balance between the charge transport performance and the charge retention function.

Patent Document 1: Japanese Patent Application Laid-Open (JP-A) No. 61-62040

Patent Document 2: JP-A No. 1-205171

Patent Document 3: JP-A No. 7-333881

Patent Document 4: JP-A No. 4-368953

Patent Document 5: JP-A No. 2002-162759

Patent Document 6: JP-A No. 2002-128883

Patent Document 7: JP-A No. 2007-199659

Patent Document 8: JP-A No. 2002-333730

Patent Document 9: JP-A No. 5-113670

Patent Document 10: JP-A No. 8-234468

Patent Document 11: JP-A No. 2005-115091

Patent Document 12: JP-A No. 2002-214807

Patent Document 13: JP-A No. 2004-93865

DISCLOSURE OF INVENTION

Problem to be Solved by the Invention

However, these patent documents do not suggest system or methods that are sufficient to maintain satisfactory electrical properties or image characteristics, while the frictional resistance of the photoreceptor drum surface is continually maintained to be low from the beginning to after printing.

Thus, it is an object of the present invention to provide a photoreceptor for electrophotography which enables a reduction of the frictional resistance of the surface of the photoreceptor drum throughout the period from the beginning to after printing, and which decreases the amount of wear so as to obtain satisfactory images, a method for producing the photoreceptor, and an electrophotographic apparatus.

Means for Solving Problem

In order to solve the problems described above, the inventors of the present invention conducted an investigation on photosensitive layers to which resins having low coefficients of friction are applied, and as a result, they paid attention to polyallylates. Inter alia, the inventors found that when a polyallylate containing a particular siloxane structure is used as a resin binder, a photoreceptor for electrophotography which sustains a low coefficient of friction at the photoreceptor surface can be realized. Furthermore, the inventors found that when a particular polyallylate structure is introduced into the resin, rigidity of the resin is increased, and as a result, a photoreceptor for electrophotography in which a good balance is achieved between a low coefficient of friction and a low level of abrasion, and which has excellent electrical properties, can be realized. Thus, the inventors completed the present invention.

That is, the photoreceptor for electrophotography of the present invention is a photoreceptor for electrophotography having a photosensitive layer on a conductive substrate, and is characterized in that the photosensitive layer contains, as a resin binder, a copolymerized polyallylate resin having a structure represented by the following chemical structural formula (1).

(Chemical Structural Formula (1))
(A)
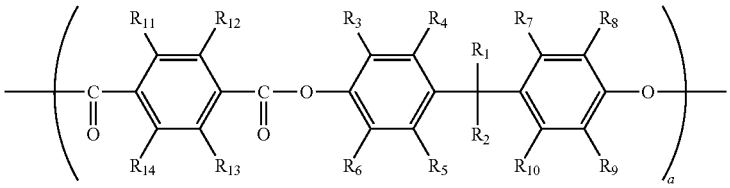
(B)
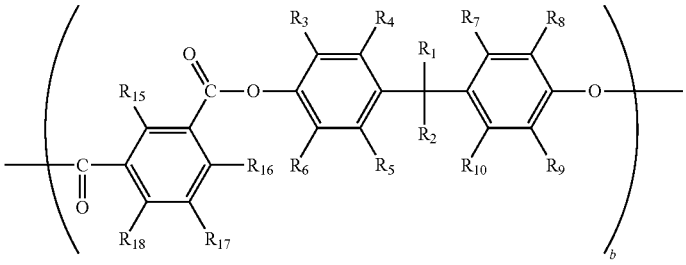
(C)
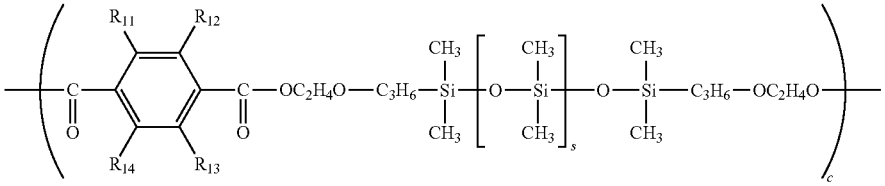
(D)
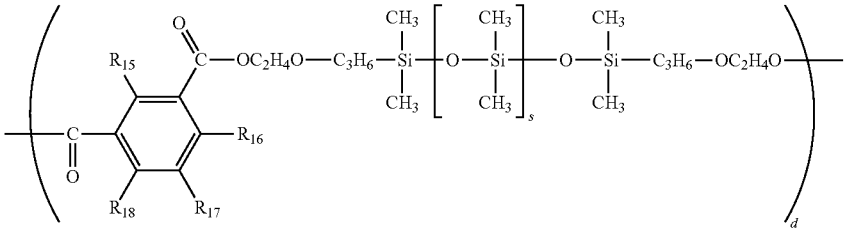
(E)
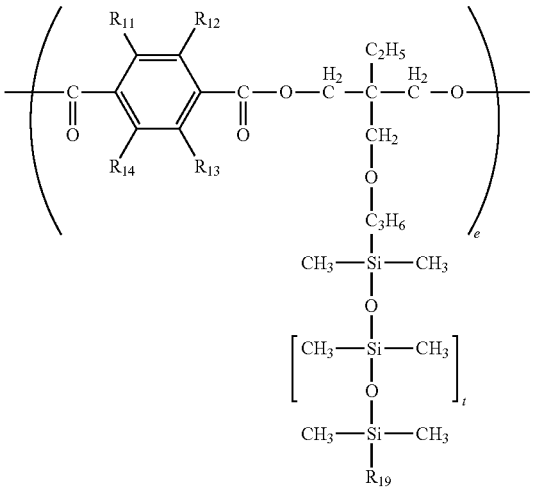
(F)
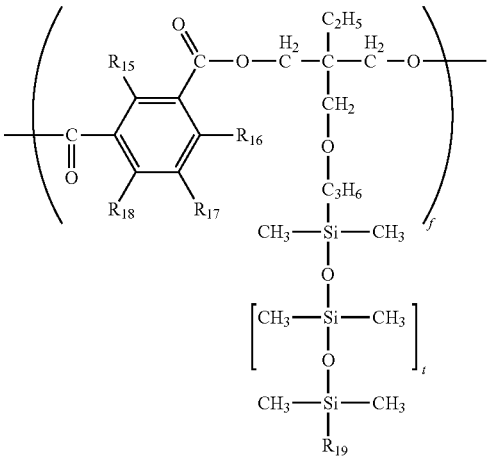

wherein in the chemical structural formula (1), partial structural formulas (A), (B), (C), (D), (E) and (F) represent structural units that constitute the resin binder; symbols a, b, c, d, e and f represent the molar percentages (mol %) of the structural units (A), (B), (C), (D), (E) and (F), respectively, with the sum (a+b+c+d+e+f) being 100 mol %; $R_1$ and $R_2$, which may be identical or different, each represent a hydrogen atom, an alkyl group having 1 to 8 carbon atoms, a cycloalkyl group which may be substituted, or an aryl group which may be substituted, or $R_1$ and $R_2$ may form a cyclic structure together with the carbon atom to which $R_1$ and $R_2$ are bonded, while the cyclic structure may have one or two arylene groups bonded thereto; $R_3$ to $R_{18}$, which may be identical or different, each represent a hydrogen atom, an alkyl group having 1 to 8 carbon atoms, a fluorine atom, a chlorine atom, or a bromine atom; $R_{19}$ represents a hydrogen atom, an alkyl group having 1 to 20 carbon atoms, an alkylene group having 1 to 20 carbon atoms, an aryl group which may be substituted, a cycloalkyl group which may be substituted, a fluorine atom, a chlorine atom, or a bromine atom; and symbols s and t each represent an integer of 1 or greater.

In regard to the photoreceptor of the present invention, in the chemical structural formula (1), c and d are preferably 0 mol %, and e and f are preferably 0 mol %. Furthermore, as the amount of the siloxane component, the sum (c+d+e+f) is preferably 0.001 mol % to 10 mol %. In the chemical structural formula (1), it is preferable that $R_1$ and $R_2$ each are a methyl group, and $R_3$ to $R_{18}$ are hydrogen atoms.

The photoreceptor of the present invention is suitably such that the photosensitive layer is of a laminated type which includes at least a charge generation layer and a charge transport layer, and the charge transport layer contains the copolymerized polyallylate resin and a charge transporting material. Furthermore, the photoreceptor of the present invention is suitably such that the photosensitive layer is of a single layer type and contains the copolymerized polyallylate resin, a charge generating material, and a charge transporting material. Furthermore, the photoreceptor of the present invention is suitably such that the photosensitive layer is of a laminated type which includes at least a charge transport layer and a charge generation layer, and the charge generation layer contains the copolymerized polyallylate resin, a charge generating material, and a charge transporting material. In this case, the charge transport layer may not necessarily contain the polyallylate resin.

The method for producing a photoreceptor for electrophotography of the present invention is a method for producing a photoreceptor for electrophotography which includes a step of applying a coating liquid containing at least a resin binder on a conductive substrate and thereby forming a photosensitive layer, and is characterized in that the coating liquid contains a copolymerized polyallylate resin represented by the chemical structural formula (1) as a resin binder.

The electrophotographic apparatus of the present invention is characterized by having the electrophotographic photoreceptor described above mounted therein.

Effect of the Invention

According to the present invention, when a copolymerized polyallylate resin formed from the particularly structural unit described above was used as a resin binder for a photosensitive layer, the surface of the photosensitive layer could maintain a low coefficient of friction from the beginning to after printing, while the electrophotographic characteristics of the photoreceptor were maintained. Furthermore, cleaning properties were enhanced, and a photoreceptor for electrophotography capable of obtaining satisfactory images could be realized. In addition, it has become clear that the copolymerized polyallylate resin is a resin having high rigidity and excellent mechanical strength.

Furthermore, ($P_2$-1-6) which is the resin described in Patent Document 10, is such that the polyester structure of the phthalic acid/bisphenol moiety is the same as the structural formula (A) of the present invention. Since $P_2$-1-6 uses a siloxane-containing divalent phenol, a phenyl group is interposed on the siloxane side of the ester structural moiety. Similarly, Patent Document 12 also uses a phenolic hydroxyl group when a siloxane structure introduced into the resin. These resin structures have a problem that the resin rigidity increases too much, and resistance to breakage (cracks) due to the internal stress at the time of film formation is decreased. On the contrary, in regard to the introduction of a siloxane moiety in the present invention, the resin contains an alcoholic hydroxyl group (hydroxyalkyl) structure at both ends or at a single end of the siloxane moiety, and the alcoholic hydroxyl group is bonded via ester bonding to introduce the siloxane structure to the resin. Furthermore, the siloxane structure and the alcoholic hydroxyl group are bonded via ether bonding. Therefore, the resin acquires a structure containing an ethylene moiety and an ether bond, and there can be expected an effect that the internal stress is easily relieved. On the contrary to the incorporation of a siloxane structure based on a phenolic hydroxyl group of the related art, no examples on the polyallylate resin of the present invention in which a siloxane structure based on an alcoholic hydroxyl group structure is incorporated, are available in the related art.

Furthermore, according to the present invention, the structural formulas (E) and (F) are structures containing a single-terminal type siloxane component, and has $R_{19}$ at an end. Accordingly, there is obtained an effect that the compatibility between the resin and the charge transporting material can be controlled. In addition, since the structural formula (E) has a configuration in which the siloxane component is in a skewered form with respect to the main chain of the resin, the relationship between the molecular weight and the viscosity of the coating liquid can be changed to the structural formulas (C) and (D) in which the siloxane structure is incorporated in the form of main chain, by means of an effect based on the branched structure.

EXPLANATIONS OF LETTERS OR NUMERALS

Figure 1A:
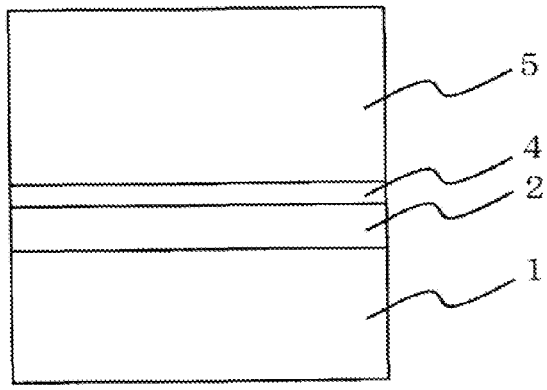
In FIG. 1, (a) is a schematic cross-sectional diagram showing a negatively charged, functionally separated laminated type photoreceptor for electrophotography according to the present invention; (b) is a schematic cross-sectional diagram showing a positively charged, single layer type photoreceptor for electrophotography according to the present invention; and (c) is a schematic cross-sectional diagram showing a positively charged laminated type photoreceptor for electrophotography according to the present invention.

1 conductive substrate
2 undercoat layer
3 single layer type photosensitive layer
4 charge generation layer
5 charge transport layer
7 photoreceptor
21 roller charging member
22 high voltage power supply
23 image exposure member
24 development machine
241 development roller
25 paper supply member
251 paper supply roller
252 paper supply guide
26 transfer charging unit (direct charging type)
27 cleaning device
271 cleaning blade
28 deelectrifying member
60 electrophotographic apparatus
300 photosensitive layer

BEST MODE(S) FOR CARRYING OUT THE INVENTION

Hereinafter, embodiments of the present invention will be described in detail with reference to the attached drawings. The present invention is not intended to be limited by the following descriptions.

Figure 1B:
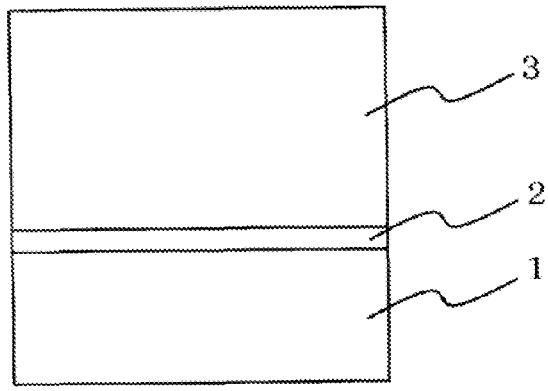
Figure 1C:
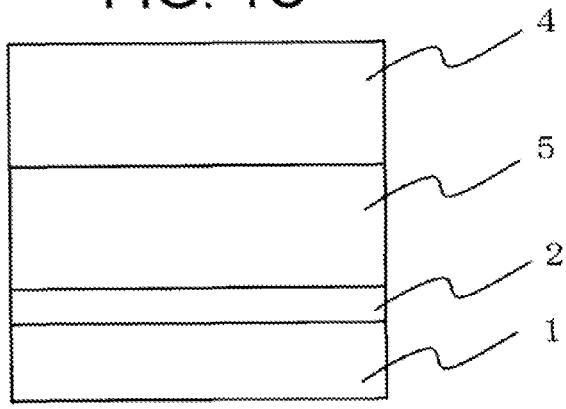

As discussed above, photoreceptors for electrophotography are roughly classified into so-called negatively charged laminated type photoreceptors and positively charged laminated type photoreceptors as laminated type (functionally separated type) photoreceptors, and single layer type photoreceptors which are mainly used as positively charged type. FIG. 1 is a set of schematic cross-sectional diagrams showing the photoreceptor for electrophotography according to one embodiment of the present invention, while (a) shows a negatively charged laminated type photoreceptor for electrophotography, (b) shows a positively charged single layer type photoreceptor for electrophotography, and (c) shows a positively charged laminated type photoreceptor for electrophotography. As depicted in the diagrams, in the negatively charged laminated type photoreceptor, an undercoat layer 2, and a photosensitive layer which includes a charge generation layer 4 having a charge generating function and a charge transport layer 5 having a charge transporting function are sequentially laminated on a conductive substrate 1. On the other hand, in the positively charged single layer type photoreceptor, an undercoat layer 2, and a single layer type photosensitive layer 3 which combines both a charge generating function and a charge transporting function are sequentially laminated on a conductive substrate 1. Furthermore, in the positively charged laminated type photoreceptor, an undercoat layer 2, and a photosensitive layer which includes a charge transport layer 5 having a charge transporting function and a charge generation layer 4 having both a charge generating function and a charge transporting function are sequentially laminated on a conductive substrate 1. For all types of the photoreceptors, the undercoat layer 2 may be provided according to necessity. The "photosensitive layer" of the present invention includes both a laminated type photosensitive layer in which a charge generation layer and a charge transport layer are laminated, and a single layer type photosensitive layer.

The conductive substrate 1 serves as an electrode of the photoreceptor and also as a support for the various layers constituting the photoreceptor, and may have any shape such as a cylindrical shape, a plate shape, or a film shape. Examples of the material of the conductive substrate 1 that can be used include metals such as aluminum, stainless steel, and nickel; and products obtained by subjecting the surface of glass, a resin and the like to a conductive treatment.

The undercoat layer 2 is formed from a layer containing a resin as a main component, or a metal oxide film of alumite or the like. Such an undercoat layer 2 is provided as necessary, in order to control the charge injectability from the conductive substrate 1 to the photosensitive layer, or for the purposes of covering the defects on the surface of the conductive substrate, enhancing the adhesiveness between the photosensitive layer and the conductive substrate 1, and the like. Examples of the resin material used for the undercoat layer 2 include insulating polymers such as casein, polyvinyl alcohol, polyamide, melamine, and cellulose; and electrically conductive polymers such as polythiophene, polypyrrole, and polyaniline. These resins can be used singly, or in appropriate combinations and mixtures. Furthermore, these resins having metal oxides such as titanium dioxide and zinc oxide incorporated therein, may also be used.

(Negatively Charged Laminated Type Photoreceptor)

In the negatively charged laminated type photoreceptor, the charge generation layer 4 is formed by a method such as applying a coating liquid in which particles of a charge generating material are dispersed in a resin binder, and the layer receives light and generates charges. Furthermore, it is important for the charge generation layer 4 to have high charge generation efficiency and to have an ability to inject charges into the charge transport layer 5, and it is desirable that the charge generation layer 4 is less dependent on the electric field and is effective in injection even at low electric fields. Examples of the charge generating material include phthalocyanine compounds such as X-type metal-free phthalocyanine, τ-type metal-free phthalocyanine, α-type titanyl phthalocyanine, β-type titanyl phthalocyanine, Y-type titanyl phthalocyanine, γ-type titanyl phthalocyaine, amorphous titanyl phthalocyanine, and ϵ-type copper phthalocyanine; various azo pigments, anthanthrone pigments, thiapyrylium pigments, perylene pigments, perinone pigments, squarylium pigments, and quinacridone pigments. These compounds can be used singly or in appropriate combination, and suitable substances can be selected in accordance with the light wavelength region of the exposure light source used in image formation.

Since it is preferable that the charge generation layer 4 have a charge generating function, the film thickness is determined from the coefficient of light absorption of the charge generating material. The film thickness is generally 1 μm or less, and suitably 0.5 μm or less. In regard to the charge generation layer 4, a charge generating material can be used as a main material, and a charge transporting material and the like can be added thereto. Examples of the resin binder include polymers and copolymers of a polycarbonate resin, a polyester resin, a polyamide resin, a polyurethane resin, a vinyl chloride resin, a vinyl acetate resin, a phenoxy resin, a polyvinyl acetal resin, a polyvinyl butyral resin, a polystyrene resin, a polysulfone resin, a diallyl phthalate resin, and a methacrylic acid ester resin, and these polymers can be used in appropriate combination.

The charge transport layer 5 is composed mainly of a charge transporting material and a resin binder. According to the present invention, it is necessary to use a copolymerized polyallylate resin having the structural unit represented by the chemical structural formula (1), as a binder. Thereby, the expected effects of the present invention can be obtained.

In regard to the photoreceptor of the present invention, such a copolymerized polyallylate resin may have other structural units. When the total amount of the copolymerized polyallylate resin is designated as 100, the mixing ratio of the structural unit represented by the chemical structural formula (1) is preferably 10 mol % to 100 mol %, and particularly preferably 50 mol % to 100 mol %.

Furthermore, in regard to the photoreceptor of the present invention, when the total amount of the structural unit represented by the chemical structural formula (1), the sum (a+b+c+d+e+f), is designated as 100 mol %, the sum (c+d+e+f) as the amount of the siloxane component is suitably 0.001 mol % to 10 mol %, and more preferably 0.03 mol % to 10 mol %. When the sum (c+d+e+f) is less than 0.001 mol %, there is a risk that a sufficient coefficient of friction that can be sustained may not be obtained. On the other hand, when the sum (c+d+e+f) is greater than 10 mol %, sufficient film hardness may not be obtained, and there is a risk that when the polyallylate resin is prepared into a coating liquid, sufficient compatibility with the solvent or functional materials may not be obtained.

In the chemical structural formula (1), when c and d are 0 mol %, which implies that the structural formula (C) and the structural formula (D) are not included, or when e and f are 0 mol %, which implies that the structural formula (E) and the structural formula (F) are not included, similarly the anticipated effects of the present invention can be obtained.

Furthermore, in the chemical structural formula (1), symbols s and t represent integers from 1 to 400, and preferably integers from 8 to 250.

It is preferable that the photoreceptor of the present invention be formed from a bisphenol A type copolymerized polyallylate resin in which in the chemical structural formula (1), $R_1$ and $R_2$ are methyl groups, and $R_3$ to $R_{18}$ are hydrogen atoms.

Furthermore, examples of the siloxane structure of the copolymerized polyallylate resin of the chemical structural formula (1) include constituent monomers represented by the following molecular formula (2) [reactive silicone SILAPLANE FM4411 (number average molecular weight 1000), FM4421 (number average molecular weight 5000), and FM4425 (number average molecular weight 15000), manufactured by Chisso Corp.], and constituent monomers represented by the following molecular formula (3) [reactive silicone SILAPLANE FMDA11 (number average molecular weight 1000), FMDA21 (number average molecular weight 5000), and FMDA26 (number average molecular weight 15000), manufactured by Chisso Corp.].

Molecular Formula (2)

| Structural formula No. | Basic structure | Average molecular weight | Structure example |
|---|---|---|---|
| Formula (2)-1 | 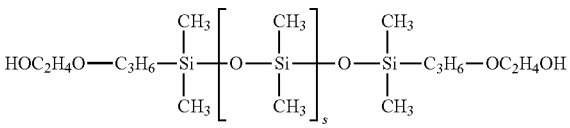 | 1000 | SILAPLANE FM-4411 manufactured by Chisso Corp. |
| Formula (2)-2 | | 5000 | SILAPLANE FM 4421 manufactured by Chisso Corp. |
| Formula (2)-3 | | 10000 | SILAPLANE FM-4425 manufactured by Chisso Corp. |

Molecular Formula (3)

| Structural formula No. | Basic structure | Average molecular weight | Structure example |
|---|---|---|---|
| Formula (3)-1 | 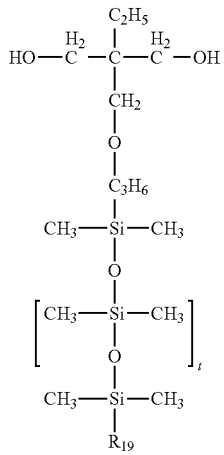 | 1000 | SILAPLANE FM-DA11 manufactured by Chisso Corp. |
| Formula (3)-2 | | 5000 | SILAPLANE FM-DA21 manufactured by Chisso Corp. |
| Formula (3)-3 | | 15000 | SILAPLANE FM-DA26 manufactured by Chisso Corp. |

wherein $R_{19}$ represents an n-butyl group.

The copolymerized polyallylate resin represented by the chemical structural formula (1) may be used singly, or may be used as a mixture with another resin. Examples of such other resin that can be used include other polyallylate resins; various polycarbonate resins such as bisphenol A type, bisphenol Z type, a bisphenol A type-biphenyl copolymer, a bisphenol Z type-biphenyl copolymer; polyphenylene resins, polyester resins, polyvinyl acetal resins, polyvinyl butyral resins, polyvinyl alcohol resins, vinyl chloride resins, vinyl acetate resins, polyethylene resins, polypropylene resins, acrylic resins, polyurethane resins, epoxy resins, melamine resins, silicone resins, polyamide resins, polystyrene resins, polyacetal resins, polysulfone resins, polymers of methacrylic acid esters, and copolymers of these polymers. It is also acceptable to mix resins of the same kind, which have different molecular weights, and to use such a mixture.

The content of the resin binder is suitably 10% to 90% by mass, and more suitably 20% to 80% by mass, relative to the solids content of the charge transport layer 5. Furthermore, the content of the copolymerized polyallylate resin relative to the amount of such a resin binder is suitably in the range of 1% by mass to 100% by mass, and more suitably 5% by mass to 80% by mass.

The weight average molecular weight of such a polyallylate resin is suitably 5,000 to 250,000, and more suitably 10,000 to 150,000.

Shown below are specific examples of the structural formulas (A) to (F), which are the structural units represented by the chemical structural formula (1). Furthermore, specific examples of copolymerized polyallylate resins having the structural formulas (A) to (F) are presented in the following Table 1. However, the copolymerized polyallylate resin according to the present invention is not intended to be limited to resins of these exemplary structures.

Specific Examples of Structural Formula (A)

A1

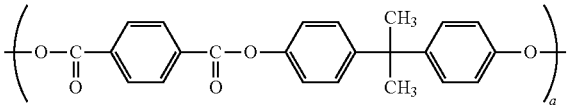

A2

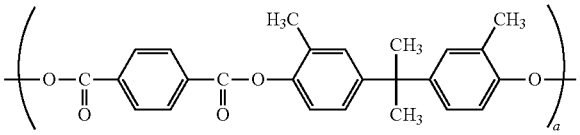

A3

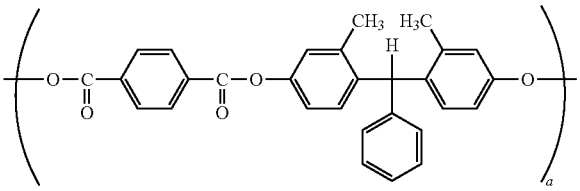

A4

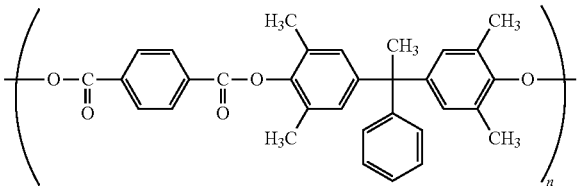

A5

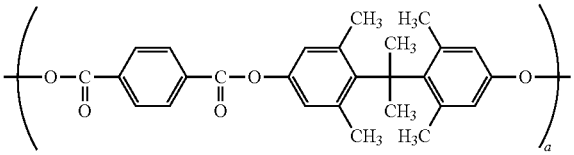

A6

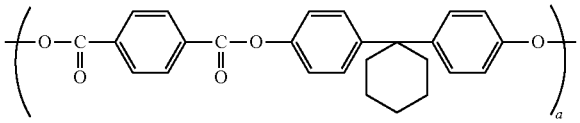

A7

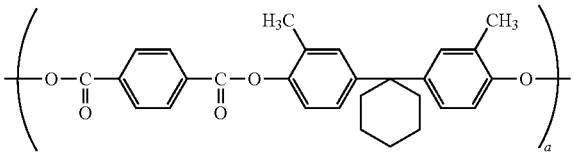

-continued

A8

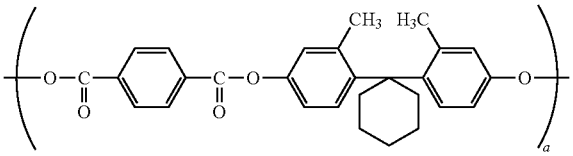

A9

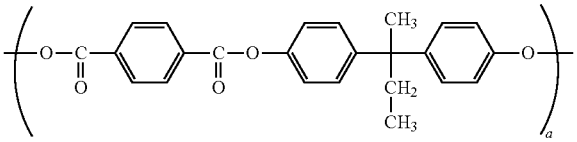

A10

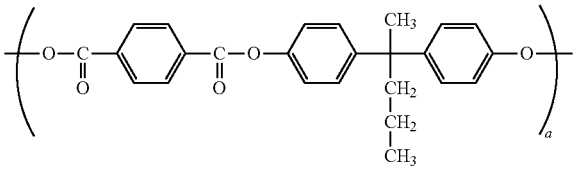

Specific Examples of Structural Formula (B)

B1

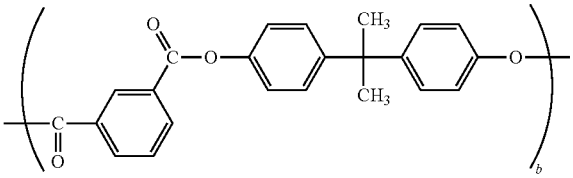

B2

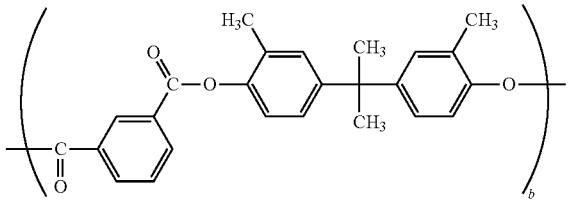

B3

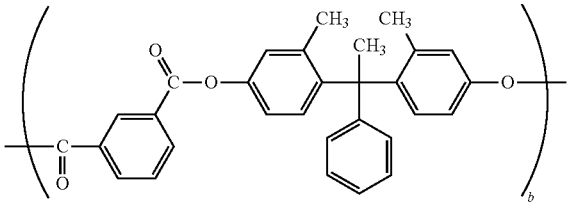

B4

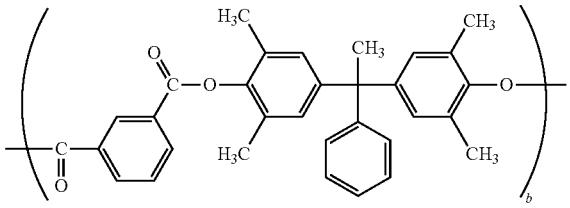

-continued
B5
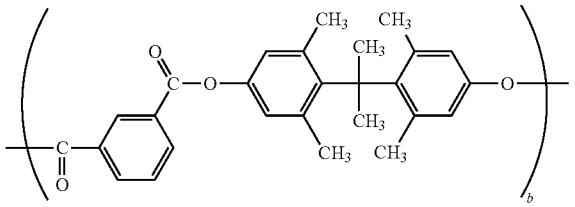
B6
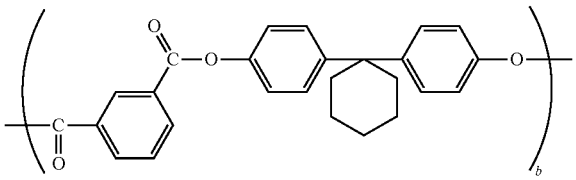
B7
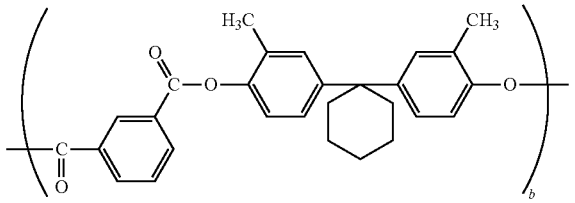
-continued
B8
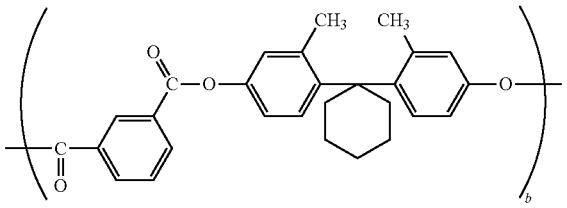
B9
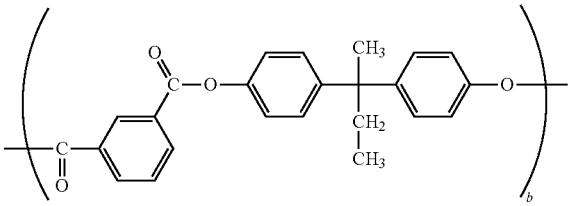
B10
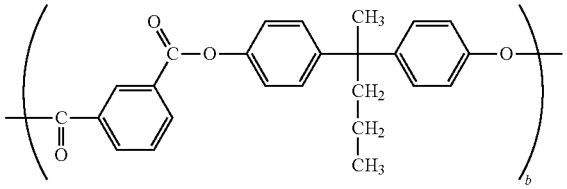
Specific Example of Structural Formula (C)
C1
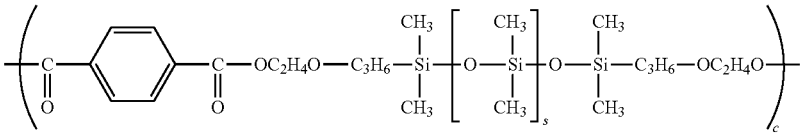
Specific Example of Structural Formula (D)
D1
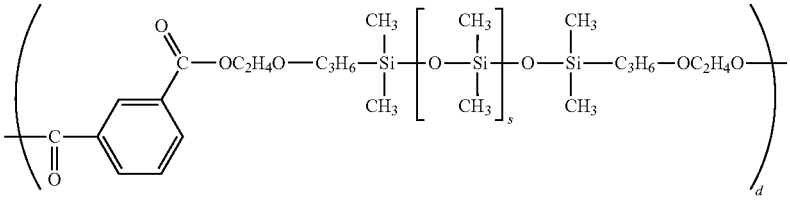

Specific Example of Structural Formula (E)

E1

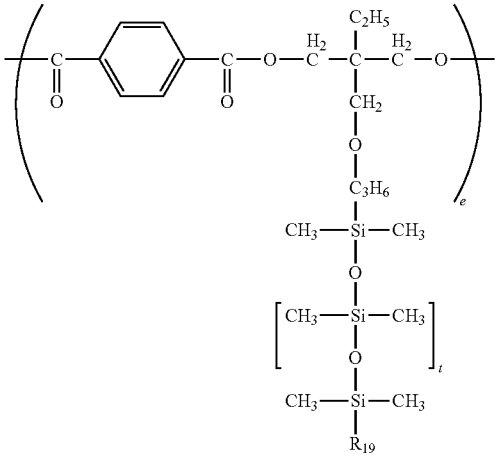

Specific Example of Structural Formula (F)

F1

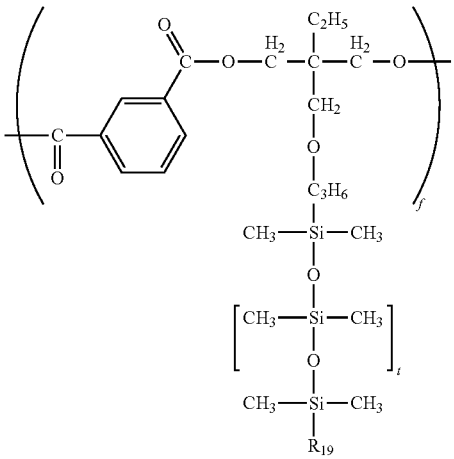

wherein $R_{19}$ represents an n-butyl group.

TABLE 1

| | Type of structural unit | | | | | |
|---|---|---|---|---|---|---|
| Structure No. | A | B | C | D | E | F |
| I-1 | A1 | B1 | C1 | D1 | | |
| I-2 | A2 | B2 | C1 | D1 | | |
| I-3 | A3 | B3 | C1 | D1 | | |
| I-4 | A4 | B4 | C1 | D1 | | |
| I-5 | A5 | B5 | C1 | D1 | | |
| I-6 | A6 | B6 | C1 | D1 | | |
| I-7 | A7 | B7 | C1 | D1 | | |
| I-8 | A8 | B8 | C1 | D1 | | |
| I-9 | A9 | B9 | C1 | D1 | | |
| I-10 | A10 | B10 | C1 | D1 | | |
| I-11 | A1 | B1 | | | E1 | F1 |
| I-12 | A2 | B2 | | | E1 | F1 |
| I-13 | A3 | B3 | | | E1 | F1 |
| I-14 | A4 | B4 | | | E1 | F1 |
| I-15 | A5 | B5 | | | E1 | F1 |
| I-16 | A6 | B6 | | | E1 | F1 |
| I-17 | A7 | B7 | | | E1 | F1 |
| I-18 | A8 | B8 | | | E1 | F1 |
| I-19 | A9 | B9 | | | E1 | F1 |
| I-20 | A10 | B10 | | | E1 | F1 |
| I-21 | A1 | B1 | C1 | D1 | E1 | F1 |
| I-22 | A2 | B2 | C1 | D1 | E1 | F1 |
| I-23 | A3 | B3 | C1 | D1 | E1 | F1 |
| I-24 | A4 | B4 | C1 | D1 | E1 | F1 |
| I-25 | A5 | B5 | C1 | D1 | E1 | F1 |
| I-26 | A6 | B6 | C1 | D1 | E1 | F1 |
| I-27 | A7 | B7 | C1 | D1 | E1 | F1 |
| I-28 | A8 | B8 | C1 | D1 | E1 | F1 |
| I-29 | A9 | B9 | C1 | D1 | E1 | F1 |
| I-30 | A10 | B10 | C1 | D1 | E1 | F1 |

As the charge transporting material of the charge transport layer 5, various hydrazone compounds, styryl compounds, diamine compounds, butadiene compounds, indole compounds and the like can be used singly, or as mixtures of appropriate combination. Examples of such a charge transporting material include, but are not limited to, compounds represented by the following formulas (II-1) to (II-14).

II-1

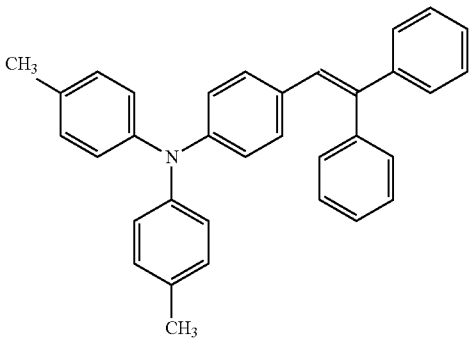

II-2

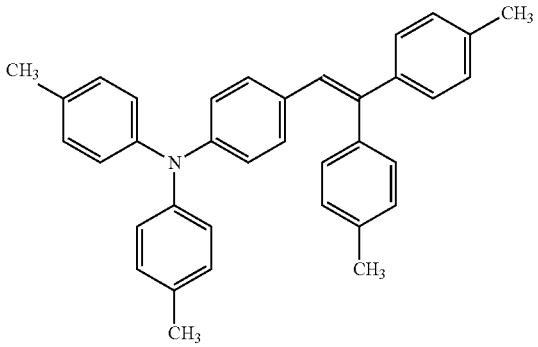

-continued
II-3
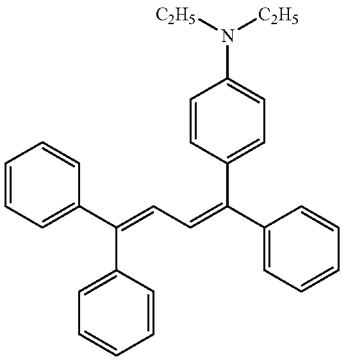
II-4
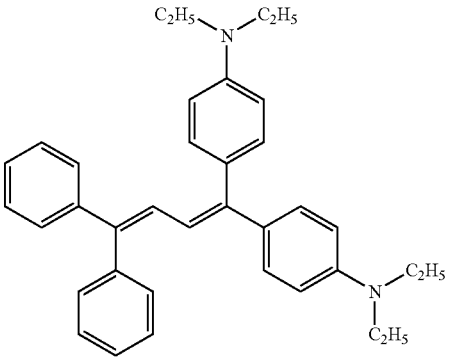
II-5
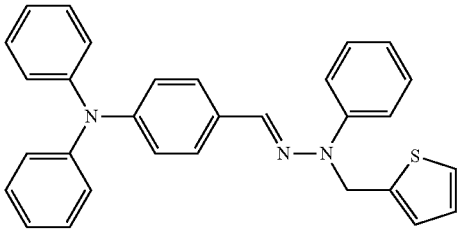
II-6
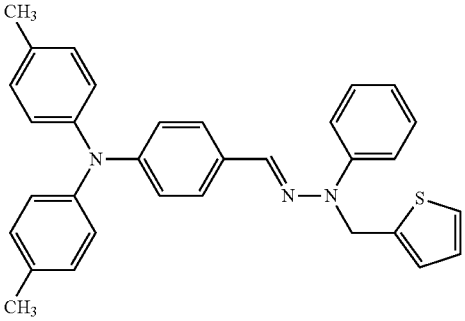
II-7
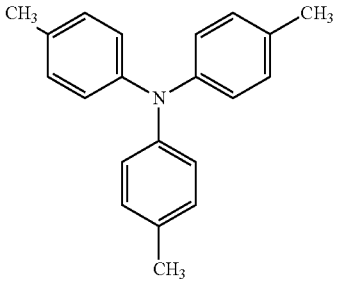
II-8
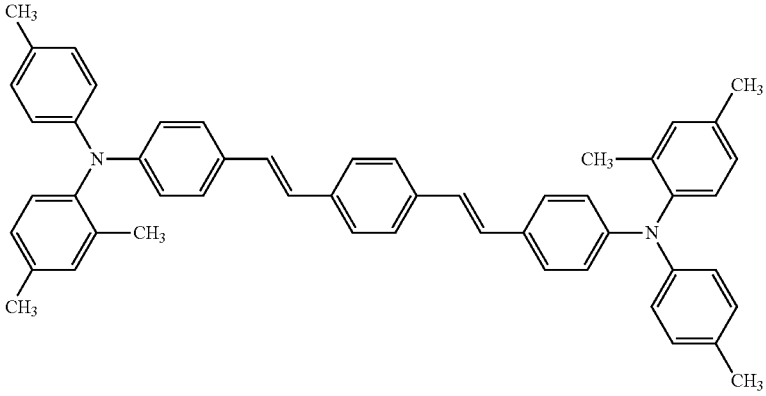

-continued

II-9

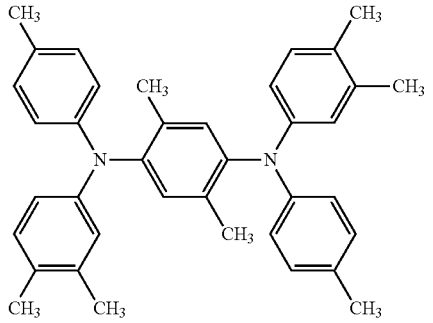

II-10

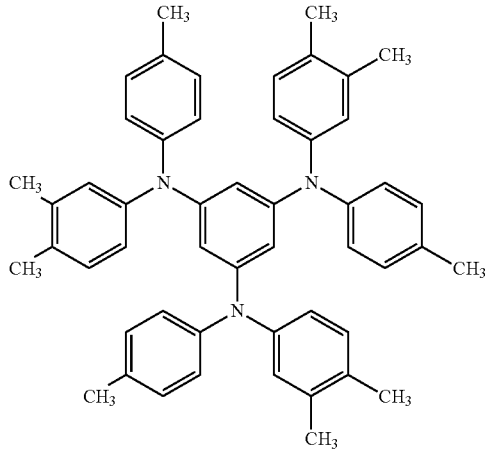

II-11

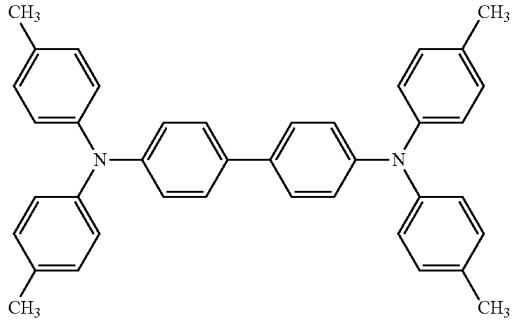

II-12

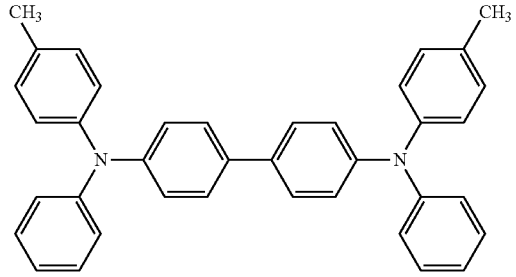

II-13

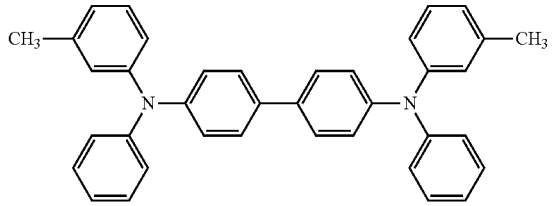

II-14

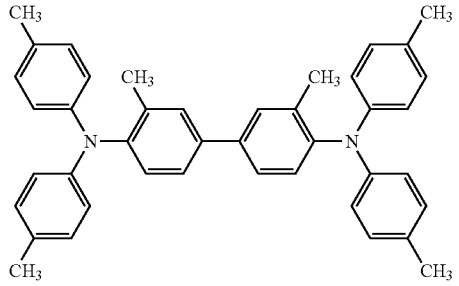

The thickness of the charge transport layer 5 is preferably in the range of 3 to 50 μm, and more preferably in the range of 15 to 40 μm, in order to maintain the practically effective surface potential.

(Single Layer Type Photoreceptor)

According to the present invention, the photosensitive layer 3 in the case of a single layer type is composed mainly of a charge generating material, a hole transporting material, an electron transporting material (acceptor compound), and a resin binder. According to the present invention, it is necessary to use a copolymerized polyallylate resin having a structural unit represented by the chemical structural formula (1) as a resin binder for the single layer type photosensitive layer 3. Such a copolymerized polyallylate resin may further have other structural units. When the total amount of the copolymerized polyallylate resin is designated as 100, the mixing ratio of the structural unit represented by the chemical structural formula (1) is preferably 10 mol % to 100 mol %, and particularly preferably 50 mol % to 100 mol %.

Examples of the charge generating material that can be used include phthalocyanine-based pigments, azo pigments, anthanthrone pigments, perylene pigments, perinone pigments, polycyclic quinone pigments, squarylium pigments, thiapyrylium pigments, and quinacridone pigments. These charge generating materials can be used singly, or two or more kinds can be used in combination. Particularly, preferable examples of the charge generating material for the photoreceptor for electrophotography of the present invention include, as azo pigments, a disazo pigment and a trisazo pigment; as perylene pigments, N,N'-bis(3,5-dimethylphenyl)-3,4:9,10-perylene-bis(carboximide); and as phthalocyanine-based pigments, metal-free phthalocyanine, copper phthalocyanine, and titanyl phthalocyanine. Furthermore, when X-type metal-free phthalocyanine, τ-type metal-free phthalocyanine, ϵ-type copper phthalocyanine, α-type titanyl phthalocyanine, β-type titanyl phthalocyanine, Y-type titanyl phthalocyanine, amorphous titanyl phthalocyanine, and the titanyl phthalocyanines described in JP-A No. 8-209023, U.S. Pat. Nos. 5,736,282 and 5,874,570, which have a Bragg angle 2θ of 9.6° as the maximum peak in the CuKα: X-ray diffraction spectroscopy, are used, markedly improved effects in terms of sensitivity, durability and image quality are exhibited. The content of the charge generating material is suitably 0.1% to 20% by mass, and more suitably 0.5 to 10% by mass, relative to the solids content of the single layer type photosensitive layer 3.

Examples of the hole transporting material that can be used include hydrazone compounds, pyrazoline compounds, pyrazolone compounds, oxadiazole compounds, oxazole compounds, arylamine compounds, benzidine compounds, stilbene compounds, styryl compounds, poly-N-vinylcarbazole, and polysilanes. These hole transporting materials can be used singly, or two or more kinds can be used in combination. Preferred as the hole transporting material used in the present invention are compounds having an excellent ability to transport holes that are generated at the time of light irradiation, as well as compounds that are suitable for mixing with a charge generating material. The content of the hole transporting material is suitably 3% to 80% by mass, and more suitably 5% to 60% by mass, relative to the solids content of the single layer type photosensitive layer 3.

Examples of the electron transporting material (acceptor compound) include succinic acid anhydride, maleic acid anhydride, dibromosuccinic acid anhydride, phthalic acid anhydride, 3-nitrophthalic acid anhydride, 4-nitrophthalic acid anhydride, pyromellitic acid anhydride, pyromellitic acid, trimellitic acid, trimellitic acid anhydride, phthalimide, 4-nitrophthalimide, tetracyanoethylene, tetracyanoquinodimethane, chloranyl, bromanyl, o-nitrobenzoic acid, malononitrile, trinitrofluorenone, trinitrothioxanthone, dinitrobenzene, dinitroanthracene, dinitroacridine, nitroanthraquinone, dinitroanthraquinone, thiopyrane-based compounds, quinone-based compounds, benzoquinone compounds, diphenoquinone-based compounds, naphthoquinone-based compounds, anthraquinone-based compounds, stilbenequinone-based compounds, and azoquinone-based compounds. Furthermore, these electron transporting materials can be used singly, or two or more kinds can be used in combination. The content of the electron transporting material is suitably 1% to 50% by mass, and more suitably 5% to 40% by mass, relative to the solids content of the single layer type photosensitive layer 3.

According to the present invention, it is necessary to use a copolymerized polyallylate resin having a structural unit represented by the chemical structural formula (1) as a resin binder for the single layer type photosensitive layer 3. Thereby, the anticipated effects of the present invention can be obtained. Examples of such a copolymerized polyallylate resin include the same compounds as those described above.

As the resin binder of the single layer type photosensitive layer 3, the copolymerized polyallylate resin represented by the chemical structural formula (1) may be used singly, or may be used as mixtures with other resins. Examples of such other resins that can be used include various polycarbonate resins such as bisphenol A type, bisphenol Z type, a bisphenol A type-biphenyl copolymer, and a bisphenol Z type-biphenyl copolymer; polyphenylene resins, polyester resins, polyvinyl acetal resins, polyvinyl butyral resins, polyvinyl alcohol resins, vinyl chloride resins, vinyl acetate resins, polyethylene resins, polypropylene resins, acrylic resins, polyurethane resins, epoxy resins, melamine resins, silicone resins, polyamide resins, polystyrene resins, polyacetal resins, other polyallylate resins, polysulfone resins, polymers of methacrylic acid esters, and copolymers of these polymers. Furthermore, resins of the same kind which have different molecular weights may also be used in mixture.

The content of the resin binder is suitably 10% to 90% by mass, and more suitably 20% to 80% by mass, relative to the solids content of the single layer type photosensitive layer 3. Furthermore, the content of the copolymerized polyallylate resin relative to the amount of such resin binder is suitably in the range of 1% by mass to 100% by mass, and more suitably 5% by mass to 80% by mass.

The thickness of the single layer type photosensitive layer 3 is preferably in the range of 3 to 100 μm, and more preferably in the range of 5 to 40 μm, in order to maintain a practically effective surface potential.

(Positively Charged Laminated Type Photoreceptor)

In the positively charged laminated type photoreceptor, the charge transport layer 5 is composed mainly of a charge transporting material and a resin binder. For the charge transporting material and the resin binder, the same materials as those exemplified in the embodiment of the charge transport layer 5 in the negatively charged laminated type photoreceptor can be used. The contents of the respective materials and the thickness of the charge transport layer 5 are also defined to be the same as in the case of the negatively charged laminated type photoreceptor. In addition, the copolymerized polyallylate resin having a structural unit represented by the chemical structural formula (1) can be arbitrarily used as the resin binder.

The charge generation layer 4 that is provided on the charge transport layer 5 is composed mainly of a charge generating material, a hole transporting material, an electron transporting material (acceptor compound), and a resin binder. For the charge generating material, hole transporting material, electron transporting material and resin binder, the same materials as those exemplified in the embodiment of the single layer type photosensitive layer 3 in the single layer type photoreceptor can be used. The contents of the respective materials and the thickness of the charge generation layer 4 are also defined to be the same as in the case of the single layer type photosensitive layer 3 in the single layer type photoreceptor. In the positively charged laminated type photoreceptor, it is necessary to use a copolymerized polyallylate resin having a structural unit represented by the chemical structural formula (1) as a resin binder of the charge generation layer 4.

According to the present invention, all of the laminated type and single layer type photosensitive layers can contain deterioration preventing agents such as an oxidation inhibitor and a light stabilizer, for the purpose of enhancing environmental resistance or stability against harmful light. Examples of the compounds that are used for these purposes include chromanol derivatives such as tocopherol and esterification compounds; polyarylalkane compounds, hydroquinone derivatives, etherified compounds, dietherified compounds, benzophenone derivatives, benzotriazole derivatives, thioether compounds, phenylene diamine derivatives, phosphonic acid esters, phosphorous acid esters, phenol compounds, hindered phenol compounds, linear amine compounds, cyclic amine compounds, and hindered amine compounds.

Furthermore, a leveling agent such as a silicone oil or a fluorine-based oil can be incorporated into the photosensitive layer for the purpose of enhancing the leveling property of the formed film or imparting lubricity. Also, for the purposes of regulating the film hardness, reducing the coefficient of friction, imparting lubricity and the like, fine particles of a metal oxide such as silicon oxide (silica), titanium oxide, zinc oxide, calcium oxide, aluminum oxide (alumina), or zirconium oxide; a metal sulfide such as barium sulfate or calcium sulfate; and a metal nitride such as silicon nitride or aluminum nitride; particles of a fluororesin such as a tetrafluoroethylene resin; a fluorine-based comb-like graft polymerized resin and the like may also be incorporated. Furthermore, if necessary, other known additives can be incorporated to the extent that the electrophotographic characteristics are not significantly impaired.

(Electrophotographic Apparatus)

When the photoreceptor for electrophotography of the present invention is applied to various machine processes, the anticipated effects are obtained. Specifically, sufficient effects are obtained even in the charging processes of contact charging systems using a roller or a brush, and non-contact charging systems using a corotron, a scorotron or the like; and in the development processes of contact development systems and non-contact development systems which use non-magnetic one-component, magnetic one-component, and two-component development systems, and the like.

Figure 4:
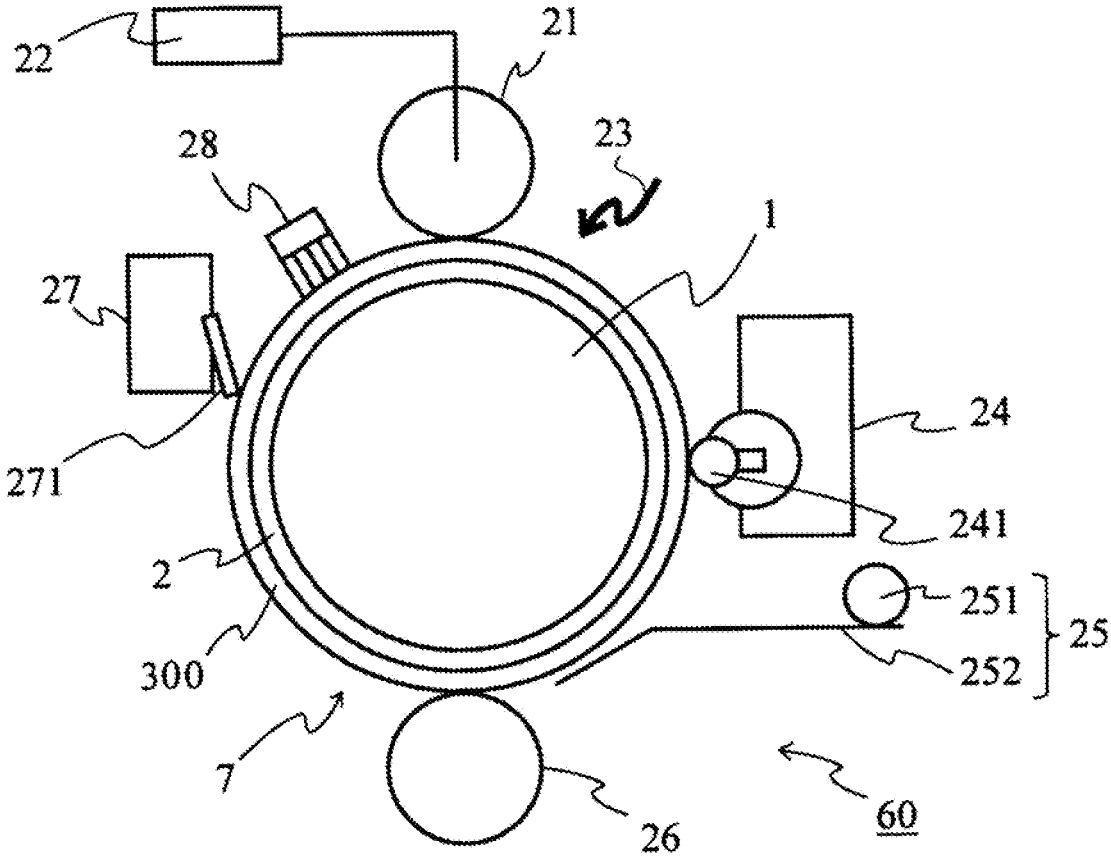
FIG. 4 is a schematic configuration diagram of an electrophotographic apparatus according to the present invention.

For instance, FIG. 4 presents a schematic configuration diagram of an electrophotographic apparatus according to the present invention. The electrophotographic apparatus 60 of the present invention is mounted with a conductive substrate 1, and coated on the outer circumferential surface thereof, the electrophotographic photoreceptor 7 of the present invention which includes an undercoat layer 2 and a photosensitive layer 300. This electrophotographic apparatus 60 is composed of a roller charging member 21 that is disposed at the outer circumferential area of the photoreceptor 7; a high voltage power supply 22 that supplies an applied voltage to this roller charging member 21; an image exposure member 23; a development machine 24 equipped with a development roller 241; a paper supply member 25 equipped with a paper supply roller 251 and a paper supply guide 252; a transfer charging machine (direct charging type) 26; a cleaning device 27 equipped with a cleaning blade 271; and a deelectrifying member 28. Furthermore, the electrophotographic apparatus 60 of the present invention can be manufactured into a color printer.

EXAMPLES

Hereinafter, specific embodiments of the present invention will be described in more detail by way of Examples, but the present invention is not intended to be limited to the following Examples as long as the gist is maintained.

Preparation of Copolymerized Polyallylate Resin

Production Example 1

Method for Producing Copolymerized Polyallylate Resin (III-1)

Figure 2:
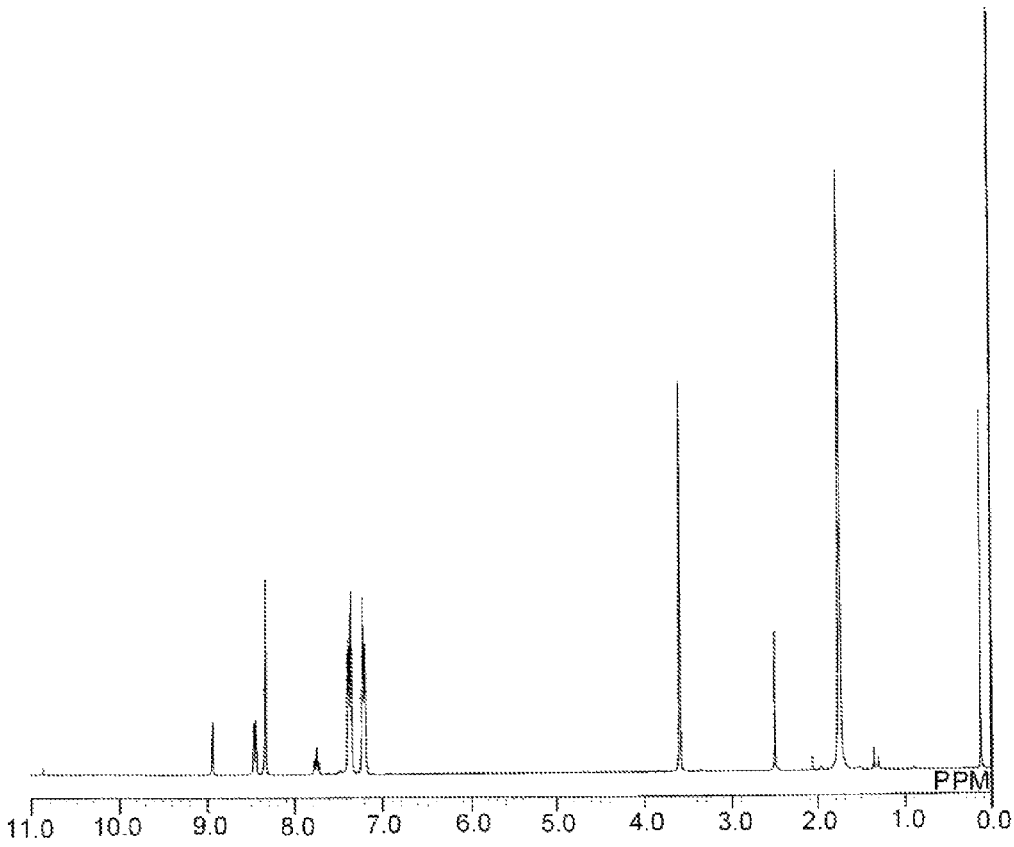
FIG. 2 is a diagram showing the $^1$H-NMR spectrum of a copolymerized polyallylate resin (III-1) (in a THF-$d_8$ solvent).

In a 2-liter four-necked flat bottom flask, 540 mL of ion-exchanged water, 12.4 g of NaOH, 0.459 g of p-tert-butylphenol, 30.257 g of bisphenol A, 3.988 g of a compound of molecular formula (2)-3 (trade name: "SILAPLANE FM-4425" manufactured by Chisso Corp.), and 0.272 g of tetrabutylammonium bromide were introduced. Subsequently, 12.268 g of terephthalic acid chloride and 14.994 g of isophthalic acid chloride were dissolved in 540 mL of methylene chloride to prepare a solution, and the solution was introduced into the flask for about 2 minutes. The resulting mixture was stirred for 1.5 hours, and thus a reaction was carried out. After completion of the reaction, 360 mL of methylene chloride was added thereto to dilute the reaction mixture. The aqueous phase was separated and was used to perform reprecipitation in methanol in a four-fold volume. The reprecipitation product was dried at 60° C. for 2 hours, and then the product thus obtained was dissolved in methylene chloride to obtain a 5% solution. The solution was added to 3 L of ion-exchanged water, and the resin was washed by reprecipitation. This washing process was carried out until the conductivity of the washing water dropped to 5 μS/m or less. The resin thus obtained was dissolved again in methylene chloride to a concentration of 5% by mass, and the solution was added dropwise to acetone in a five-fold amount under stirring, and thus reprecipitation was carried out. A precipitate thus obtained was filtered and dried for 2 hours at 60° C., and thus 34.3 g of the target polymer was obtained. The $^1$H-NMR spectrum of this copolymerized polyallylate resin (III-1) in THF-$d_8$ solvent is presented in FIG. 2, and the copolymerization ratio is presented in the following as well as in Tables 2 and 3.

a:b:c:d=44.865:54.835:0.135:0.165 (III-1)

The weight average molecular weight of this resin III-1 relative to polystyrene standards was measured by a GPC (gel permeation) analysis, and the molecular weight was found to be 85,000.

Production Example 2

Method for Producing Copolymerized Polyallylate Resin (III-2)

Synthesis of the resin was carried out in the same manner as in Production Example 1, except that the amount of bisphenol A used in Production Example 1 was changed to 30.303 g, and the amount of the compound of molecular formula (2)-3 was changed to 1.994 g. The copolymerization ratio of the copolymerized polyallylate resin (III-2) thus obtained is presented in Tables 2 and 3.

Production Example 3

Method for Producing Copolymerized Polyallylate Resin (III-3)

Synthesis of the resin was carried out in the same manner as in Production Example 1, except that the amount of bisphenol A used in Production Example 1 was changed to 30.326 g, and the amount of the compound of molecular formula (2)-3 was changed to 0.997 g. The copolymerization ratio of the copolymerized polyallylate resin (III-3) thus obtained is presented in Tables 2 and 3.

Production Example 4

Method for Producing Copolymerized Polyallylate Resin (III-4)

Synthesis of the resin was carried out in the same manner as in Production Example 1, except that the amount of bisphenol A used in Production Example 1 was changed to 30.045 g, the compound of molecular formula (2)-3 was changed to a compound of molecular formula (2)-2 (trade name: "SILAPLANE FM-4421" manufactured by Chisso Corp.), and the amount of the compound of molecular formula (2)-2 was set to 6.647 g. The copolymerization ratio of the copolymerized polyallylate resin (III-4) thus obtained is presented in Tables 2 and 3.

Production Example 5

Method for Producing Copolymerized Polyallylate Resin (III-5)

Synthesis of the resin was carried out in the same manner as in Production Example 4, except that the amount of bisphenol A used in Production Example 4 was changed to 30.197 g, and the amount of the compound of molecular formula (2)-2 was changed to 3.323 g. The copolymerization ratio of the copolymerized polyallylate resin (III-5) thus obtained is presented in Tables 2 and 3.

Production Example 6

Method for Producing Copolymerized Polyallylate Resin (III-6)

Synthesis of the resin was carried out in the same manner as in Production Example 4, except that the amount of bisphenol A used in Production Example 4 was changed to 30.288 g, and the amount of the compound of molecular formula (2)-2 was changed to 1.329 g. The copolymerization ratio of the copolymerized polyallylate resin (III-6) thus obtained is presented in Tables 2 and 3.

Production Example 7

Method for Producing Copolymerized Polyallylate Resin (III-7)

Synthesis of the resin was carried out in the same manner as in Production Example 1, except that the amount of bisphenol A used in Production Example 1 was changed to 27.921 g, the compound of molecular formula (2)-3 was changed to a compound of molecular formula (2)-1 (trade name: "SILAPLANE FM-4411" manufactured by Chisso Corp.), and the amount of the compound of molecular formula (2)-1 was set to 10.635 g. The copolymerization ratio of the copolymerized polyallylate resin (III-7) thus obtained is presented in Tables 2 and 3.

Production Example 8

Method for Producing Copolymerized Polyallylate Resin (III-8)

Synthesis of the resin was carried out in the same manner as in Production Example 7, except that the amount of bisphenol A used in Production Example 7 was changed to 29.134 g, and the amount of the compound of molecular formula (2)-1 was changed to 5.318 g. The copolymerization ratio of the copolymerized polyallylate resin (III-8) thus obtained is presented in Tables 2 and 3.

Production Example 9

Method for Producing Copolymerized Polyallylate Resin (III-9)

Synthesis of the resin was carried out in the same manner as in Production Example 7, except that the amount of bisphenol A used in Production Example 7 was changed to 30.045 g, and the amount of the compound of molecular formula (2)-1 was changed to 1.329 g. The copolymerization ratio of the copolymerized polyallylate resin (III-9) thus obtained is presented in Tables 2 and 3.

Production Example 10

Method for Producing Copolymerized Polyallylate Resin (III-10)

Figure 3:
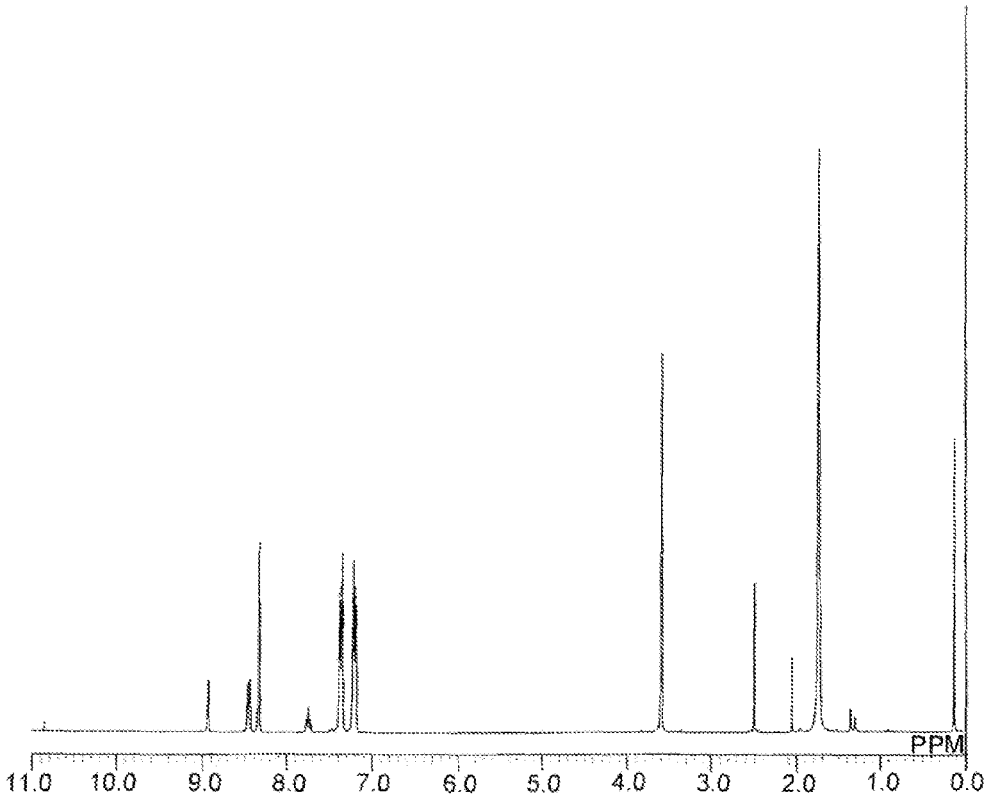
FIG. 3 is a diagram showing the $^1$H-NMR spectrum of a copolymerized polyallylate resin (III-10) (in a THF-$d_8$ solvent).

Synthesis of the resin was carried out in the same manner as in Production Example 1, except that the amount of bisphenol A used in Production Example 1 was changed to 30.288 g, the compound of molecular formula (2)-3 was changed to a compound of molecular formula (3)-3 (trade name: "SILAPLANE FMDA26" manufactured by Chisso Corp.), and the amount of the compound of molecular formula (3)-3 was set to 3.988 g. The $^1$H-NMR spectrum of this copolymerized polyallylate resin (III-10) in THF-$d_8$ solvent is presented in FIG. 3, and the copolymerization ratio thereof is presented in Tables 2 and 3. The weight average molecular weight of this resin III-10 relative to polystyrene standards was measured by a GPC (gel permeation) analysis, and the molecular weight was found to be 87,000.

Production Example 11

Method for Producing Copolymerized Polyallylate Resin (III-11)

Synthesis of the resin was carried out in the same manner as in Production Example 10, except that the amount of bisphenol A used in Production Example 10 was changed to 30.318 g, and the amount of the compound of molecular formula (3)-3 was changed to 1.994 g. The copolymerization ratio of the copolymerized polyallylate resin (III-11) thus obtained is presented in Tables 2 and 3.

Production Example 12

Method for Producing Copolymerized Polyallylate Resin (III-12)

Synthesis of the resin was carried out in the same manner as in Production Example 10, except that the amount of bisphenol A used in Production Example 10 was changed to 30.333 g, and the amount of the compound of molecular formula (3)-3 was changed to 0.997 g. The copolymerization ratio of the copolymerized polyallylate resin (III-12) thus obtained is presented in Tables 2 and 3.

Production Example 13

Method for Producing Copolymerized Polyallylate Resin (III-13)

Synthesis of the resin was carried out in the same manner as in Production Example 1, except that the amount of bisphenol A used in Production Example 1 was changed to 30.045 g, the compound of molecular formula (2)-3 was changed to a compound of molecular formula (3)-2 (trade name: "SILAPLANE FMDA21" manufactured by Chisso Corp.), and the amount of the compound of molecular formula (3)-2 was set to 6.647 g. The copolymerization ratio of the copolymerized polyallylate resin (III-13) thus obtained is presented in Tables 2 and 3.

Production Example 14

Method for Producing Copolymerized Polyallylate Resin (III-14)

Synthesis of the resin was carried out in the same manner as in Production Example 13, except that the amount of bisphenol A used in Production Example 13 was changed to 30.197 g, and the amount of the compound of molecular formula (3)-2 was changed to 3.323 g. The copolymerization ratio of the copolymerized polyallylate resin (III-14) thus obtained is presented in Tables 2 and 3.

Production Example 15

Method for Producing Copolymerized Polyallylate Resin (III-15)

Synthesis of the resin was carried out in the same manner as in Production Example 13, except that the amount of bisphenol A used in Production Example 13 was changed to 30.288 g, and the amount of the compound of molecular formula (3)-2 was changed to 1.329 g. The copolymerization ratio of the copolymerized polyallylate resin (III-15) thus obtained is presented in Tables 2 and 3.

Production Example 16

Method for Producing Copolymerized Polyallylate Resin (III-16)

Synthesis of the resin was carried out in the same manner as in Production Example 1, except that the amount of bisphenol A used in Production Example 1 was changed to 28.831 g, the compound of molecular formula (2)-3 was changed to a compound of molecular formula (3)-1 (trade name: "SILAPLANE FMDA11" manufactured by Chisso Corp.), and the amount of the compound of molecular formula (3)-1 was set to 6.647 g. The copolymerization ratio of the copolymerized polyallylate resin (III-16) thus obtained is presented in Tables 4 and 5.

Production Example 17

Method for Producing Copolymerized Polyallylate Resin (III-17)

Synthesis of the resin was carried out in the same manner as in Production Example 16, except that the amount of bisphenol A used in Production Example 16 was changed to 29.741 g, and the amount of the compound of molecular formula (3)-1 was changed to 2.659 g. The copolymerization ratio of the copolymerized polyallylate resin (III-17) thus obtained is presented in Tables 4 and 5.

Production Example 18

Method for Producing Copolymerized Polyallylate Resin (III-18)

Synthesis of the resin was carried out in the same manner as in Production Example 16, except that the amount of bisphenol A used in Production Example 16 was changed to 30.045 g, and the amount of the compound of molecular formula (3)-1 was changed to 1.329 g. The copolymerization ratio of the copolymerized polyallylate resin (III-18) thus obtained is presented in Tables 4 and 5.

Production Example 19

Method for Producing Copolymerized Polyallylate Resin (III-19)

Synthesis of the resin was carried out in the same manner as in Production Example 1, except that the amount of bisphenol A used in Production Example 1 was changed to 30.197 g, the compound of molecular formula (2)-3 was changed to a compound of molecular formula (3)-3, and the amount of the compound of molecular formula (3)-3 was set to 4.985 g. The copolymerization ratio of the copolymerized polyallylate resin (III-19) thus obtained is presented in Tables 4 and 5.

Production Example 20

Method for Producing Copolymerized Polyallylate Resin (III-20)

Synthesis of the resin was carried out in the same manner as in Production Example 19, except that the amount of bisphenol A used in Production Example 19 was changed to 29.059 g, the compound of molecular formula (2)-3 and the compound of molecular formula (3)-3 were changed to a compound of molecular formula (2)-3 and a compound of molecular formula (3)-1, and the amount of the compound of molecular formula (2)-3 was set to 3.323 g, while the amount of the compound of molecular formula (3)-1 was set to 5.318 g. The copolymerization ratio of the copolymerized polyallylate resin (III-20) thus obtained is presented in Tables 4 and 5.

Production Example 21

Method for Producing Copolymerized Polyallylate Resin (III-21)

Synthesis of the resin was carried out in the same manner as in Production Example 19, except that the amount of bisphenol A used in Production Example 19 was changed to 28.436 g, the compound of molecular formula (2)-3 and the compound of molecular formula (3)-3 were changed to a compound of molecular formula (2)-1 and a compound of molecular formula (3)-3, and the amount of the compound of molecular formula (2)-1 was set to 7.976 g, while the amount of the compound of molecular formula (3)-3 was set to 5.982 g. The copolymerization ratio of the copolymerized polyallylate resin (III-21) thus obtained is presented in Tables 4 and 5.

Production Example 22

Method for Producing Copolymerized Polyallylate Resin (III-22)

Synthesis of the resin was carried out in the same manner as in Production Example 19, except that the amount of bisphenol A used in Production Example 19 was changed to 27.314 g, the compound of molecular formula (2)-3 and the compound of molecular formula (3)-3 were changed to a compound of molecular formula (2)-1 and a compound of molecular formula (3)-1, and the amount of the compound of molecular formula (2)-1 was set to 6.647 g, while the amount of the compound of molecular formula (3)-1 was set to 6.647 g. The copolymerization ratio of the copolymerized polyallylate resin (III-22) thus obtained is presented in Tables 4 and 5.

Production Example 23

Method for Producing Copolymerized Polyallylate Resin (III-23)

Synthesis of the resin was carried out in the same manner as in Production Example 10, except that the amount of terephthalic acid chloride used in Production Example 10 was changed to 13.631 g, and the amount of isophthalic acid chloride was changed to 13.631 g. The copolymerization ratio of the copolymerized polyallylate resin (III-23) thus obtained is presented in Tables 4 and 5.

Production Example 24

Method for Producing Copolymerized Polyallylate Resin (III-24)

Synthesis of the resin was carried out in the same manner as in Production Example 10, except that the amount of terephthalic acid chloride used in Production Example 10 was changed to 9.542 g, and the amount of isophthalic acid chloride was changed to 17.720 g. The copolymerization ratio of the copolymerized polyallylate resin (III-24) thus obtained is presented in Tables 4 and 5.

Production Example 25

Method for Producing Copolymerized Polyallylate Resin (III-25)

Synthesis of the resin was carried out in the same manner as in Production Example 10, except that the amount of terephthalic acid chloride used in Production Example 10 was changed to 14.994 g, and the amount of isophthalic acid chloride was changed to 12.268 g. The copolymerization ratio of the copolymerized polyallylate resin (III-25) thus obtained is presented in Tables 4 and 5.

Production Example 26

Method for Producing Copolymerized Polyallylate Resin (III-26)

Synthesis of the resin was carried out in the same manner as in Production Example 7, except that the amount of bisphenol A used in Production Example 7 was changed to 27.010 g, and the amount of the compound of molecular formula (2)-1 was changed to 14.623 g. The copolymerization ratio of the copolymerized polyallylate resin (III-26) thus obtained is presented in Tables 4 and 5.

Production Example 27

Method for Producing Copolymerized Polyallylate Resin (III-27)

Synthesis of the resin was carried out in the same manner as in Production Example 1, except that the amount of bisphenol A used in Production Example 1 was changed to 27.010 g, and the amount of the compound of molecular formula (2)-3 was changed to 146.232 g. The copolymerization ratio of the copolymerized polyallylate resin (III-27) thus obtained is presented in Tables 4 and 5.

Production Example 28

Method for Producing Copolymerized Polyallylate Resin (III-28)

Synthesis of the resin was carried out in the same manner as in Production Example 1, except that the amount of terephthalic acid chloride used in Production Example 1 was changed to 12.268 g, the amount of isophthalic acid chloride was changed to 14.994 g, the amount of bisphenol A was 30.348 g, and the compound of molecular formula (2)-3 was not added. The copolymerization ratio of the copolymerized polyallylate resin (III-28) thus obtained is presented in Tables 4 and 5.

Production Example 29

Method for Producing Copolymerized Polyallylate Resin (III-29)

Synthesis of the resin was carried out in the same manner as in Production Example 1, except that the amount of terephthalic acid chloride used in Production Example 1 was changed to 9.542 g, the amount of isophthalic acid chloride was changed to 17.720 g, the amount of bisphenol A was 30.348 g, and the compound of molecular formula (2)-3 was not added. The copolymerization ratio of the copolymerized polyallylate resin (III-29) thus obtained is presented in Tables 4 and 5.

Production Example 30

Method for Producing Copolymerized Polyallylate Resin (III-30)

Synthesis of the resin was carried out in the same manner as in Production Example 1, except that the amount of terephthalic acid chloride used in Production Example 1 was changed to 17.720 g, the amount of isophthalic acid chloride was changed to 9.542 g, the amount of bisphenol A was 30.348 g, and the compound of molecular formula (2)-3 was not added. The copolymerization ratio of the copolymerized polyallylate resin (III-30) thus obtained is presented in Tables 4 and 5.

TABLE 2

| | | Injection amount of raw material (mol %) | | | | |
|---|---|---|---|---|---|---|
| | | Acid chloride component | | Alcohol component | | |
| | Resin | Terephthalic acid | Isophthalic acid | Bisphenol A | Siloxane monomer | Siloxane monomer |
| Production Example 1 | (III-1) | 55 | 45 | 99.7 | 0.3 | — |
| Production Example 2 | (III-2) | 55 | 45 | 99.85 | 0.15 | — |
| Production Example 3 | (III-3) | 55 | 45 | 99.925 | 0.075 | — |
| Production Example 4 | (III-4) | 55 | 45 | 99 | 1 | — |
| Production Example 5 | (III-5) | 55 | 45 | 99.5 | 0.5 | — |

TABLE 2-continued

| | | Injection amount of raw material (mol %) | | | | |
|---|---|---|---|---|---|---|
| | | Acid chloride component | | Alcohol component | | |
| | Resin | Terephthalic acid | Isophthalic acid | Bisphenol A | Siloxane monomer | Siloxane monomer |
| Production Example 6 | (III-6) | 55 | 45 | 99.8 | 0.2 | — |
| Production Example 7 | (III-7) | 55 | 45 | 92 | 8 | — |
| Production Example 8 | (III-8) | 55 | 45 | 96 | 4 | — |
| Production Example 9 | (III-9) | 55 | 45 | 99 | 1 | — |
| Production Example 10 | (III-10) | 55 | 45 | 99.8 | 0.2 | — |
| Production Example 11 | (III-11) | 55 | 45 | 99.9 | 0.1 | — |
| Production Example 12 | (III-12) | 55 | 45 | 99.95 | 0.05 | — |
| Production Example 13 | (III-13) | 55 | 45 | 99 | 1 | — |
| Production Example 14 | (III-14) | 55 | 45 | 99.5 | 0.5 | — |
| Production Example 15 | (III-15) | 55 | 45 | 99.8 | 0.2 | — |

TABLE 3

| | | Resin copolymerization ratio | | | | | | |
|---|---|---|---|---|---|---|---|---|
| | Resin | a mol % | b mol % | C mol % | d mol % | e mol % | f mol % | C + d + e + f |
| Production Example 1 | (III-1) | 44.865 | 54.835 | 0.135 | 0.165 | 0.000 | 0.000 | 0.3 |
| Production Example 2 | (III-2) | 44.933 | 54.918 | 0.068 | 0.083 | 0.000 | 0.000 | 0.15 |
| Production Example 3 | (III-3) | 44.966 | 54.959 | 0.034 | 0.041 | 0.000 | 0.000 | 0.075 |
| Production Example 4 | (III-4) | 44.550 | 54.450 | 0.450 | 0.550 | 0.000 | 0.000 | 1 |
| Production Example 5 | (III-5) | 44.775 | 54.725 | 0.225 | 0.275 | 0.000 | 0.000 | 0.5 |
| Production Example 6 | (III-6) | 44.910 | 54.890 | 0.090 | 0.110 | 0.000 | 0.000 | 0.2 |
| Production Example 7 | (III-7) | 41.400 | 50.600 | 3.600 | 4.400 | 0.000 | 0.000 | 8 |
| Production Example 8 | (III-8) | 43.200 | 52.800 | 1.800 | 2.200 | 0.000 | 0.000 | 4 |
| Production Example 9 | (III-9) | 44.550 | 54.450 | 0.450 | 0.550 | 0.000 | 0.000 | 1 |
| Production Example 10 | (III-10) | 44.910 | 54.890 | 0.000 | 0.000 | 0.090 | 0.110 | 0.2 |
| Production Example 11 | (III-11) | 44.955 | 54.945 | 0.000 | 0.000 | 0.045 | 0.055 | 0.1 |
| Production Example 12 | (III-12) | 44.978 | 54.973 | 0.000 | 0.000 | 0.023 | 0.028 | 0.05 |
| Production Example 13 | (III-13) | 44.550 | 54.450 | 0.000 | 0.000 | 0.450 | 0.550 | 1 |
| Production Example 14 | (III-14) | 44.775 | 54.725 | 0.000 | 0.000 | 0.225 | 0.275 | 0.5 |
| Production Example 15 | (III-15) | 44.910 | 54.890 | 0.000 | 0.000 | 0.090 | 0.110 | 0.2 |

* In the table, the copolymerization ratio is the ratio in the case where the sum (a + b + c + d + e + f) is designated as 100 mol %.

TABLE 4

| | | Injection amount of raw material (mol %) | | | | |
|---|---|---|---|---|---|---|
| | | Acid chloride component | | Alcohol component | | |
| | Resin | Terephthalic acid | Isophthalic acid | Bisphenol A | Siloxane monomer | Siloxane monomer |
| Production Example 16 | (III-16) | 55 | 45 | 95 | 5 | — |
| Production Example 17 | (III-17) | 55 | 45 | 98 | 2 | — |
| Production Example 18 | (III-18) | 55 | 45 | 99 | 1 | — |
| Production Example 19 | (III-19) | 55 | 45 | 99.5 | 0.25 | 0.25 |
| Production Example 20 | (III-20) | 55 | 45 | 95.75 | 0.25 | 4 |
| Production Example 21 | (III-21) | 55 | 45 | 93.7 | 6 | 0.3 |
| Production Example 22 | (III-22) | 55 | 45 | 90 | 5 | 5 |
| Production Example 23 | (III-23) | 50 | 50 | 99.8 | 0.2 | — |
| Production Example 24 | (III-24) | 65 | 35 | 99.8 | 0.2 | — |
| Production Example 25 | (III-25) | 45 | 55 | 99.8 | 0.2 | — |
| Production Example 26 | (III-26) | 55 | 45 | 89 | 11 | — |
| Production Example 27 | (III-27) | 55 | 45 | 89 | 11 | — |
| Production Example 28 | (III-28) | 55 | 45 | 100 | 0 | — |
| Production Example 29 | (III-29) | 65 | 35 | 100 | 0 | — |
| Production Example 30 | (III-30) | 35 | 65 | 100 | 0 | — |

TABLE 5

| | | Resin copolymerization ratio | | | | | | |
|---|---|---|---|---|---|---|---|---|
| | Resin | a mol % | b mol % | c mol % | d mol % | E mol % | f mol % | c + d + e + f |
| Production Example 16 | (III-16) | 42.750 | 52.250 | 0.000 | 0.000 | 2.250 | 2.750 | 5 |
| Production Example 17 | (III-17) | 44.100 | 53.900 | 0.000 | 0.000 | 0.900 | 1.100 | 2 |
| Production Example 18 | (III-18) | 44.550 | 54.450 | 0.000 | 0.000 | 0.450 | 0.550 | 1 |
| Production Example 19 | (III-19) | 44.775 | 54.725 | 0.113 | 0.138 | 0.113 | 0.138 | 0.5 |
| Production Example 20 | (III-20) | 43.088 | 52.663 | 0.113 | 0.138 | 1.800 | 2.200 | 4.25 |
| Production Example 21 | (III-21) | 42.165 | 51.535 | 2.700 | 3.300 | 0.135 | 0.165 | 6.3 |
| Production Example 22 | (III-22) | 40.500 | 49.500 | 2.250 | 2.750 | 2.250 | 2.750 | 10 |
| Production Example 23 | (III-23) | 49.900 | 49.900 | 0.000 | 0.000 | 0.100 | 0.100 | 0.2 |
| Production Example 24 | (III-24) | 34.930 | 64.870 | 0.000 | 0.000 | 0.070 | 0.130 | 0.2 |
| Production Example 25 | (III-25) | 54.890 | 44.910 | 0.000 | 0.000 | 0.110 | 0.090 | 0.2 |
| Production Example 26 | (III-26) | 48.950 | 40.050 | 0.000 | 0.000 | 6.050 | 4.950 | 11 |
| Production Example 27 | (III-27) | 48.950 | 40.050 | 0.000 | 0.000 | 6.050 | 4.950 | 11 |
| Production Example 28 | (III-28) | 55.000 | 45.000 | 0.000 | 0.000 | 0.000 | 0.000 | 0 |
| Production Example 29 | (III-29) | 35.000 | 65.000 | 0.000 | 0.000 | 0.000 | 0.000 | 0 |
| Production Example 30 | (III-30) | 65.000 | 35.000 | 0.000 | 0.000 | 0.000 | 0.000 | 0 |

* In the table, the copolymerization ratio is the ratio in the case where the sum (a + b + c + d + e + f) is designated as 100 mol %.

Production of Negatively Charged Laminated Type Photoreceptor

Example 1

5 Parts by mass of an alcohol-soluble nylon (manufactured by Toray Industries, Inc., trade name: "CM8000") and 5 parts by mass of aminosilane-treated titanium oxide fine particles were dissolved and dispersed in 90 parts by mass of methanol, and thus a coating liquid 1 was prepared. This coating liquid 1 was immersion coated as an undercoat layer on the outer circumference of an aluminum cylinder having an outer diameter of 30 mm, which served as a conductive substrate 1, and the coating liquid was dried at a temperature of 100° C. for 30 minutes. Thus, an undercoat layer 2 having a thickness of 3 μm was formed.

1 part by mass of Y-type titanyl phthalocyanine as a charge generating material, and 1.5 parts by mass of a polyvinyl butyral resin (manufactured by Sekisui Chemical Co., Ltd., trade name: "S-LEC KS-1") as a resin binder were dissolved and dispersed in 60 parts by mass of dichloromethane, and thus a coating liquid 2 was prepared. This coating liquid 2 was immersion coated on this undercoat layer 2, and the coating liquid was dried at a temperature of 80° C. for 30 minutes. Thus, a charge generation layer 4 having a thickness of 0.3 μm was formed.

90 parts by mass of a compound represented by the following formula:

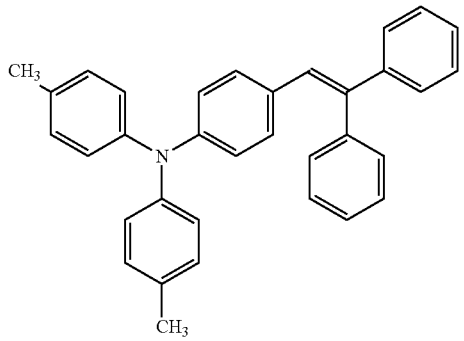

as a charge transporting material, and 110 parts by mass of the copolymerized polyallylate resin (III-1) of Production Example 1 as a resin binder were dissolved in 1000 parts by mass of dichloromethane, and thus a coating liquid 3 was prepared. The coating liquid 3 was immersion coated on this charge generation layer 4, and the coating liquid was dried at a temperature of 90° C. for 60 minutes. Thus, a charge transport layer 5 having a thickness of 25 μm was formed, and a negatively charged laminated type photoreceptor was produced.

Example 2

A photoreceptor was produced by the same method as that used in Example 1, except that the copolymerized polyallylate resin (III-1) of Production Example 1 that was used in Example 1, was replaced with the copolymerized polyallylate resin (III-2) produced in Production Example 2.

Example 3

A photoreceptor was produced by the same method as that used in Example 1, except that the copolymerized polyallylate resin (III-1) of Production Example 1 that was used in Example 1, was replaced with the copolymerized polyallylate resin (III-3) produced in Production Example 3.

Example 4

A photoreceptor was produced by the same method as that used in Example 1, except that the copolymerized polyallylate resin (III-1) of Production Example 1 that was used in Example 1, was replaced with the copolymerized polyallylate resin (III-4) produced in Production Example 4.

Example 5

A photoreceptor was produced by the same method as that used in Example 1, except that the copolymerized polyallylate resin (III-1) of Production Example 1 that was used in Example 1, was replaced with the copolymerized polyallylate resin (III-5) produced in Production Example 5.

Example 6

A photoreceptor was produced by the same method as that used in Example 1, except that the copolymerized polyallylate resin (III-1) of Production Example 1 that was used in Example 1, was replaced with the copolymerized polyallylate resin (III-6) produced in Production Example 6.

Example 7

A photoreceptor was produced by the same method as that used in Example 1, except that the copolymerized polyallylate resin (III-1) of Production Example 1 that was used in Example 1, was replaced with the copolymerized polyallylate resin (III-7) produced in Production Example 7.

Example 8

A photoreceptor was produced by the same method as that used in Example 1, except that the copolymerized polyallylate resin (III-1) of Production Example 1 that was used in Example 1, was replaced with the copolymerized polyallylate resin (III-8) produced in Production Example 8.

Example 9

A photoreceptor was produced by the same method as that used in Example 1, except that the copolymerized polyallylate resin (III-1) of Production Example 1 that was used in Example 1, was replaced with the copolymerized polyallylate resin (III-9) produced in Production Example 9.

Example 10

A photoreceptor was produced by the same method as that used in Example 1, except that the copolymerized polyallylate resin (III-1) of Production Example 1 that was used in Example 1, was replaced with the copolymerized polyallylate resin (III-10) produced in Production Example 10.

Example 11

A photoreceptor was produced by the same method as that used in Example 1, except that the copolymerized polyallylate resin (III-1) of Production Example 1 that was used in Example 1, was replaced with the copolymerized polyallylate resin (III-11) produced in Production Example 11.

Example 12

A photoreceptor was produced by the same method as that used in Example 1, except that the copolymerized polyallylate resin (III-1) of Production Example 1 that was used in Example 1, was replaced with the copolymerized polyallylate resin (III-12) produced in Production Example 12.

Example 13

A photoreceptor was produced by the same method as that used in Example 1, except that the copolymerized polyallylate resin (III-1) of Production Example 1 that was used in Example 1, was replaced with the copolymerized polyallylate resin (III-13) produced in Production Example 13.

Example 14

A photoreceptor was produced by the same method as that used in Example 1, except that the copolymerized polyallylate resin (III-1) of Production Example 1 that was used in Example 1, was replaced with the copolymerized polyallylate resin (III-14) produced in Production Example 14.

Example 15

A photoreceptor was produced by the same method as that used in Example 1, except that the copolymerized polyallylate resin (III-1) of Production Example 1 that was used in Example 1, was replaced with the copolymerized polyallylate resin (III-15) produced in Production Example 15.

Example 16

A photoreceptor was produced by the same method as that used in Example 1, except that the copolymerized polyallylate resin (III-1) of Production Example 1 that was used in Example 1, was replaced with the copolymerized polyallylate resin (III-16) produced in Production Example 16.

Example 17

A photoreceptor was produced by the same method as that used in Example 1, except that the copolymerized polyallylate resin (III-1) of Production Example 1 that was used in Example 1, was replaced with the copolymerized polyallylate resin (III-17) produced in Production Example 17.

Example 18

A photoreceptor was produced by the same method as that used in Example 1, except that the copolymerized polyallylate resin (III-1) of Production Example 1 that was used in Example 1, was replaced with the copolymerized polyallylate resin (III-18) produced in Production Example 18.

Example 19

A photoreceptor was produced by the same method as that used in Example 1, except that the copolymerized polyallylate resin (III-1) of Production Example 1 that was used in Example 1, was replaced with the copolymerized polyallylate resin (III-19) produced in Production Example 19.

Example 20

A photoreceptor was produced by the same method as that used in Example 1, except that the copolymerized polyallylate resin (III-1) of Production Example 1 that was used in Example 1, was replaced with the copolymerized polyallylate resin (III-20) produced in Production Example 20.

Example 21

A photoreceptor was produced by the same method as that used in Example 1, except that the copolymerized polyallylate resin (III-1) of Production Example 1 that was used in Example 1, was replaced with the copolymerized polyallylate resin (III-21) produced in Production Example 21.

Example 22

A photoreceptor was produced by the same method as that used in Example 1, except that the copolymerized polyallylate resin (III-1) of Production Example 1 that was used in Example 1, was replaced with the copolymerized polyallylate resin (III-22) produced in Production Example 22.

Example 23

A photoreceptor was produced by the same method as that used in Example 1, except that the copolymerized polyallylate resin (III-1) of Production Example 1 that was used in Example 1, was replaced with the copolymerized polyallylate resin (III-23) produced in Production Example 23.

Example 24

A photoreceptor was produced by the same method as that used in Example 1, except that the copolymerized polyallylate resin (III-1) of Production Example 1 that was used in Example 1, was replaced with the copolymerized polyallylate resin (III-24) produced in Production Example 24.

Example 25

A photoreceptor was produced by the same method as that used in Example 1, except that the copolymerized polyallylate resin (III-1) of Production Example 1 that was used in Example 1, was replaced with the copolymerized polyallylate resin (III-25) produced in Production Example 25.

Example 26

A photoreceptor was produced by the same method as that used in Example 1, except that the Y-type titanyl phthalocyanine used in Example 1 was replaced with $\alpha$-type titanyl phthalocyanine.

Example 27

A photoreceptor was produced by the same method as that used in Example 1, except that the charge transporting material used in Example 1 was replaced with a compound represented by the following formula.

Example 28

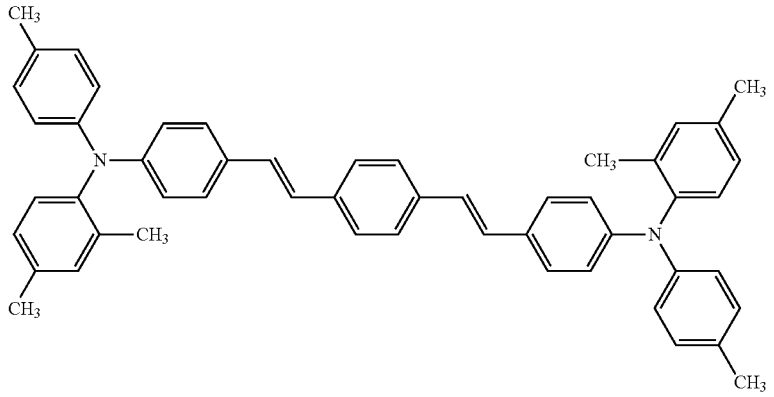

A photoreceptor was produced by the same method as that used in Example 1, except that the amount of the resin (III-1) used in Example 1 was changed to 22 parts by mass, and a resin (III-31) was added in an amount of 88 parts by mass.

Example 29

A photoreceptor was produced by the same method as that used in Example 1, except that the amount of the resin (III-1) used in Example 1 was changed to 22 parts by mass, and a resin (III-32) was added in an amount of 88 parts by mass.

Comparative Example 1

A photoreceptor was produced by the same method as that used in Example 1, except that the copolymerized polyallylate resin (III-1) of Production example 1, which was used in Example 1, was replaced with the copolymerized polyallylate resin (III-26) produced in Production Example 26.

Comparative Example 2

A photoreceptor was produced by the same method as that used in Example 1, except that the copolymerized polyallylate resin (III-1) of Production example 1, which was used in Example 1, was replaced with the copolymerized polyallylate resin (III-27) produced in Production Example 27.

Comparative Example 3

A photoreceptor was produced by the same method as that used in Example 1, except that the copolymerized polyallylate resin (III-1) of Production example 1, which was used in Example 1, was replaced with the copolymerized polyallylate resin (III-28) produced in Production Example 28.

Comparative Example 4

A photoreceptor was produced by the same method as that used in Example 1, except that the copolymerized polyallylate resin (III-1) of Production example 1, which was used in Example 1, was replaced with the copolymerized polyallylate resin (III-29) produced in Production Example 29.

Comparative Example 5

A photoreceptor was produced by the same method as that used in Example 1, except that the copolymerized polyallylate resin (III-1) of Production example 1, which was used in Example 1, was replaced with the copolymerized polyallylate resin (III-30) produced in Production Example 30.

Comparative Example 6

A photoreceptor was produced by the same method as that used in Example 1, except that the copolymerized polyallylate resin (III-1) of Production example 1, which was used in Example 1, was replaced with Polycarbonate A (S-3000, manufactured by Mitsubishi Engineering-Plastics Corp.; hereinafter, indicated as "III-31").

Comparative Example 7

A photoreceptor was produced by the same method as that used in Example 1, except that the copolymerized polyallylate resin (III-1) of Production example 1, which was used in Example 1, was replaced with Polycarbonate A (S-3000, manufactured by Mitsubishi Engineering-Plastics Corp.; hereinafter, indicated as "III-32").

Comparative Example 8

A photoreceptor was produced by the same method as that used in Example 1, except that the copolymerized polyallylate resin (III-1) of Production example 1, which was used in Example 1, was replaced with polyester resin P2-1-6 (Hereinafter indicated as "III-33") represented by the following formula described in Patent Document 10 (JP-A No. 8-234468).

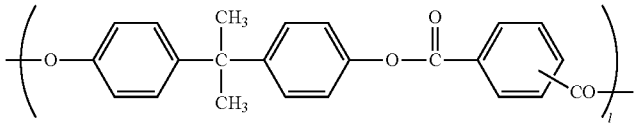

$P_2$-1-6

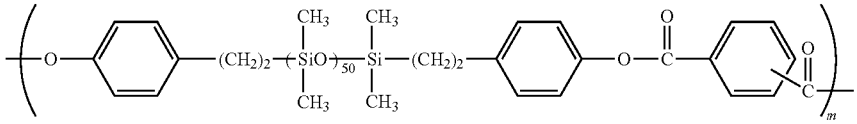

l:m = 90:10

Comparative Example 9

A photoreceptor was produced by the same method as that used in Example 1, except that the copolymerized polyallylate resin (III-1) of Production example 1, which was used in Example 1, was replaced with polyester resin A-1 (Hereinafter indicated as "III-34") represented by the following formula described in Patent Document 12 (JP-A No. 2002-214807).

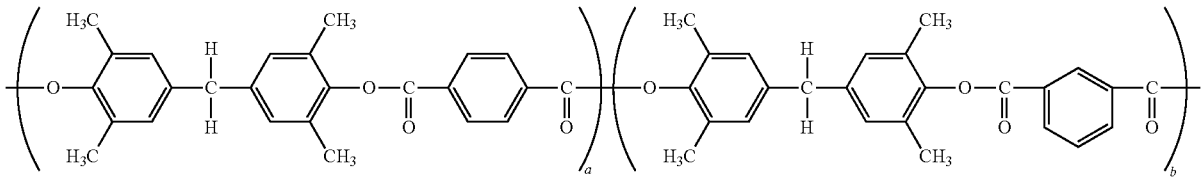

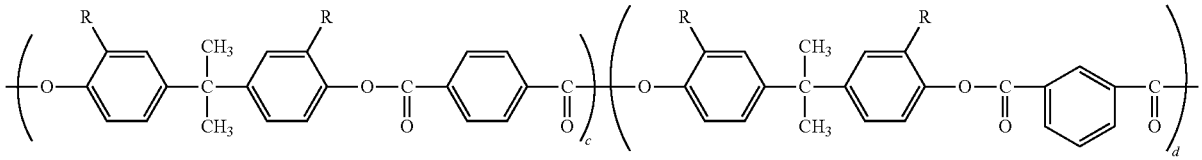

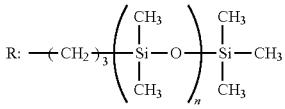

a/b = 7/3, c/d = 7/3

Production of Single Layer Type Photoreceptor

Example 30

On the outer circumference of an aluminum cylinder having an outer diameter of 24 mm as a conductive substrate 1, a coating liquid prepared by dissolving under stirring 0.2 parts by mass of a vinyl chloride-vinyl acetate-vinyl alcohol copolymer (manufactured by Nissin Chemical Industry Co., Ltd., trade name: "SOLBIN TA5R") in 99 parts by mass of methyl ethyl ketone was immersion coated as an undercoat layer, and the coating liquid was dried at a temperature of 100° C. for 30 minutes. Thus, an undercoat layer 2 having a thickness of 0.1 μm was formed.

On this undercoat layer 2, a coating liquid prepared by dissolving and dispersing 1 part by mass of a metal-free phthalocyanine represented by the following formula:

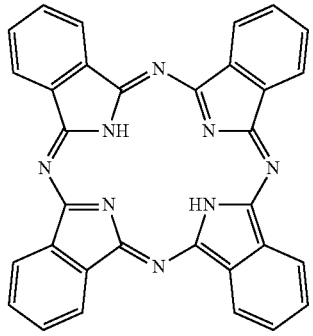

as a charge generating material, 30 parts by mass of a stilbene compound represented by the following formula:

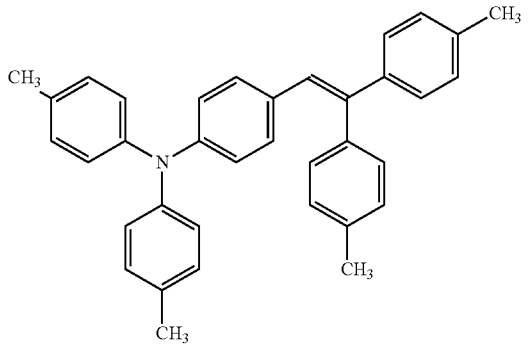

and 15 parts by mass of a stilbene compound represented by the following formula: as hole transporting materials, 30 parts by mass of a compound represented by the

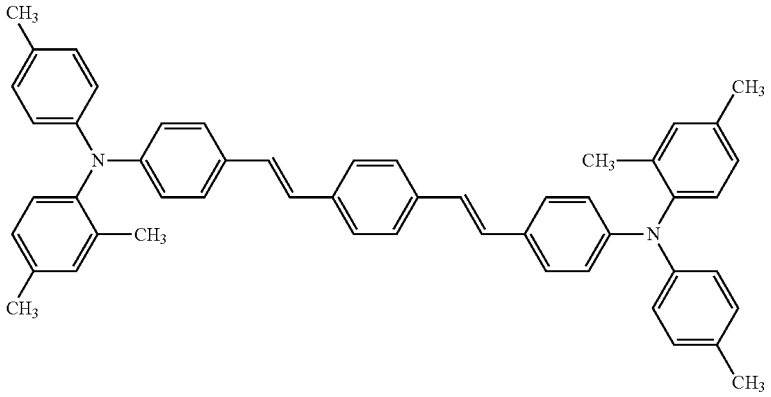

following formula:

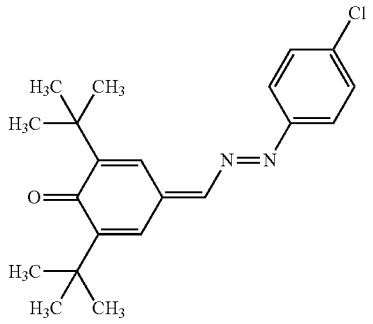

as an electron transporting material, and 55 parts by mass of the resin (III-1) of Production Example 1 as a resin binder in 350 parts by mass of tetrahydrofuran was immersion coated, and the coating liquid was dried at a temperature of 100° C. for 60 minutes. Thus, a photosensitive layer having a thickness of 25 μm was formed, and thus a single layer type photoreceptor was produced.

Example 31

A photoreceptor was produced by the same method as that used in Example 30, except that the metal-free phthalocyanine used in Example 30 was replaced with Y-type titanyl phthalocyanine.

Example 32

A photoreceptor was produced by the same method as that used in Example 30, except that the metal-free phthalocyanine used in Example 30 was replaced with α-type titanyl phthalocyanine.

Comparative Example 10

A photoreceptor was produced by the same method as that used in Example 30, except that the polyallylate resin (III-1) of Production Example 1, which was used in Example 30, was replaced with the resin (III-31).

Production of Positively Charged Laminated Type Photoreceptor

Example 33

50 parts by mass of a compound represented by the following formula:

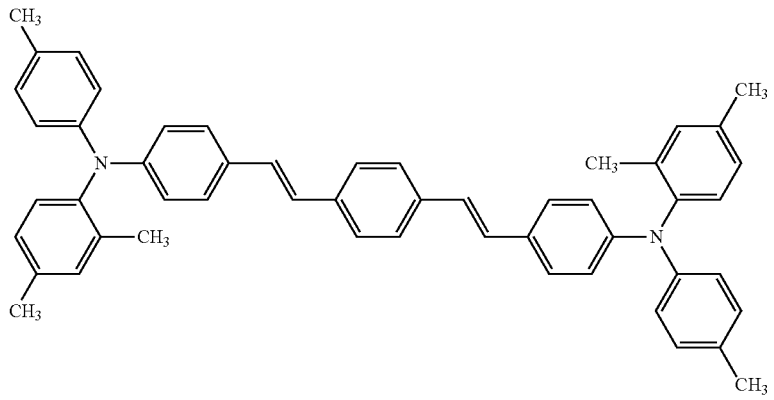

as a charge transporting material, and 50 parts by mass of Polycarbonate Z (III-31) as a resin binder were dissolved in 800 parts by mass of dichloromethane, and thus a coating liquid was prepared. This coating liquid was immersion coated on the outer circumference of an aluminum cylinder having an outer diameter of 24 mm as a conductive substrate 1, and the coating liquid was dried at a temperature of 120° C. for 60 minutes. Thus, a charge transport layer having a thickness of 15 μm was formed.

On this charge transport layer, a coating liquid prepared by dissolving and dispersing 1.5 parts by mass of a metal-free phthalocyanine represented by the

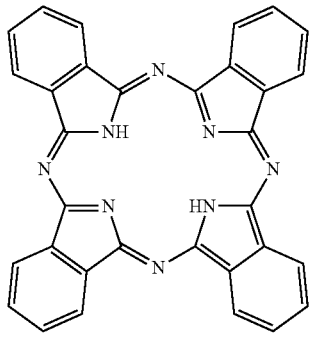

following formula:

as a charge generating material, 10 parts by mass of a stilbene compound represented by the following formula:

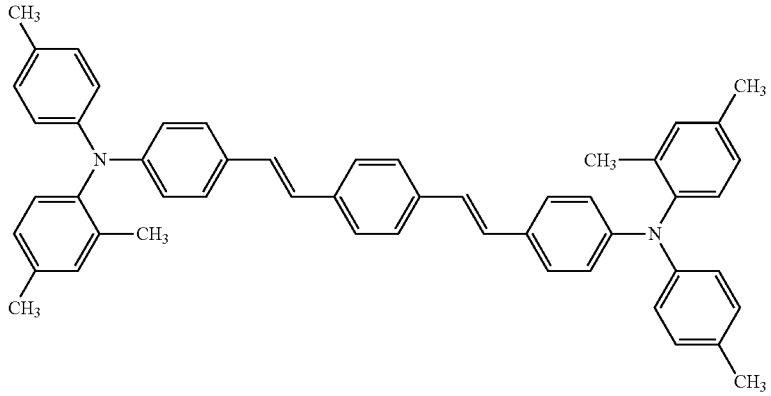

as a hole transporting material, 25 parts by mass of a compound represented by the following formula:

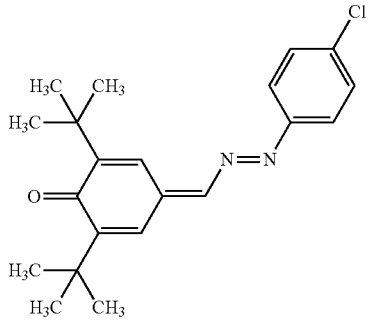

as an electron transporting material, and 60 parts by mass of the resin (III-1) of Production Example 1 as a resin binder in 800 parts by mass of 1,2-dichloroethane, was immersion coated, and the coating liquid was dried at a temperature of 100° C. for 60 minutes. Thus, a photosensitive layer having a thickness of 15 μm was formed, and thus a positively charged laminated type photoreceptor was produced.

Comparative Example 11

A photoreceptor was produced by the same method as that used in Example 33, except that the polyallylate resin (III-1) of Production Example 1, which was used in Example 33, was replaced with the resin (III-31).

<Evaluation of Photoreceptor>

The photoreceptors produced in Examples 1 to 33 and Comparative Examples 1 to 11 as described above were subjected to evaluations of lubricity and electrical properties by the methods described below. In addition, an evaluation of the solubility of the copolymerized polyallylate resins in solvents at the time of the preparation of coating liquids for charge transport layer, was also carried out as an evaluation of the state of coating liquids. The evaluation results are presented in Tables 6 to 11.

<Evaluation of Lubricity>

Lubricity of the drum surface of each the photoreceptors produced in the Examples and Comparative Examples was measured using a surface property tester (Heidon Surface Property Tester Type 14FW). The drum was mounted on LJ4000 manufactured by Hewlett-Packard Company, and printing was performed on 10,000 sheets of A4 paper. Thus, an evaluation of lubricity was carried out also for a photoreceptor after printing.

The measurement was carried out such that a urethane rubber blade was pressed against the drum surface under a constant load (20 g), and the load resulting from the friction caused by moving this blade along the longitudinal direction of the drum was defined as the frictional force.

<Electrical Properties>

For the photoreceptors of Examples 1 to 25 and Comparative Examples 1 to 9, the surface of each photoreceptor was charged at −650 V by means of corona discharge in a dark place, in an environment at a temperature of 22° C. and a humidity of 50%, and the surface potential $V_0$ immediately after charging was measured. Subsequently, the photoreceptor was left to stand for 5 seconds in the dark place, and then the surface potential $V_5$ was measured. Thus, the potential retention ratio $Vk_5$(%) at 5 seconds after the end of charging was determined according to the following calculation formula (1):

$$Vk_5=V_5/V_0\times 100 \quad (1).$$

Next, a halogen lamp was used as a light source, and the photoreceptor was irradiated with 1.0 μW/cm$^2$ of exposure light which was spectrally filtered to 780 nm using a filter, for 5 seconds starting from the time point when the surface potential reached −600 V. The amount of exposure required in light attenuation until the surface potential reached −300 V was designated as $E_{1/2}$ (μJ/cm$^2$), the residual potential at the photoreceptor surface at 5 seconds after the end of exposure was designated as Vr5 (V), and evaluations on these properties were carried out. In Examples 30 to 33 and Comparative Examples 10 to 11, evaluations were carried out in the same manner as described above while charging was achieved to +650 V, the irradiation with exposure light was initiated at a time point when the surface potential was +600 V, and $E_{1/2}$ was defined as an amount of exposure required until the surface potential reached +300 V.

<Actual Machine Characteristics>

Each of the photoreceptors produced in Examples 1 to 30 and Comparative Examples 1 to 9 was mounted on a printer LJ4000 manufactured by Hewlett-Packard Company, which had been modified so that the surface potential of the photoreceptor could be measured, and the potential at the exposed area was evaluated. Furthermore, printing was performed on 10,000 sheets of A4 paper, the thicknesses of the photoreceptor before and after the printing were measured, and thereby an evaluation on the amount of wear (μm) after the printing was carried out. Furthermore, the photoreceptors produced in Examples 30 to 33 and Comparative Examples 10 to 11 were mounted on a printer HL-2040 manufactured by Brother International Corp., which had been modified so that the surface potential of the photoreceptor could be measured, and the potential at the exposed area was evaluated. Furthermore, printing was performed on 10,000 sheets of A4 paper, the thicknesses of the photoreceptor before and after the printing were measured, and thereby an evaluation on the amount of wear (μm) after the printing was carried out.

TABLE 6

| | Resin | Solubility | Compatibility | Charging | $Vk_5$ (%) | $E_{1/2}$ (μJ/cm$^2$) | Vr5 (V) |
|---|---|---|---|---|---|---|---|
| Example 1 | (III-1) | Soluble | Good | Negative | 96 | 0.13 | 16 |
| Example 2 | (III-2) | Soluble | Good | Negative | 95 | 0.12 | 15 |
| Example 3 | (III-3) | Soluble | Good | Negative | 94 | 0.13 | 14 |
| Example 4 | (III-4) | Soluble | Good | Negative | 96 | 0.13 | 16 |
| Example 5 | (III-5) | Soluble | Good | Negative | 95 | 0.12 | 15 |
| Example 6 | (III-6) | Soluble | Good | Negative | 96 | 0.13 | 14 |
| Example 7 | (III-7) | Soluble | Good | Negative | 95 | 0.15 | 29 |
| Example 8 | (III-8) | Soluble | Good | Negative | 95 | 0.14 | 23 |
| Example 9 | (III-9) | Soluble | Good | Negative | 95 | 0.13 | 20 |
| Example 10 | (III-10) | Soluble | Good | Negative | 96 | 0.12 | 14 |
| Example 11 | (III-11) | Soluble | Good | Negative | 95 | 0.13 | 13 |
| Example 12 | (III-12) | Soluble | Good | Negative | 94 | 0.13 | 12 |
| Example 13 | (III-13) | Soluble | Good | Negative | 95 | 0.13 | 21 |
| Example 14 | (III-14) | Soluble | Good | Negative | 96 | 0.13 | 18 |
| Example 15 | (III-15) | Soluble | Good | Negative | 95 | 0.13 | 14 |
| Example 16 | (III-16) | Soluble | Good | Negative | 95 | 0.13 | 28 |
| Example 17 | (III-17) | Soluble | Good | Negative | 96 | 0.13 | 25 |

TABLE 7

| | Resin | Bright part potential of actual machine (−V) | Amount of wear (μm) | Lubricity Coefficient of dynamic friction Before printing | After printing | Image |
|---|---|---|---|---|---|---|
| Example 1 | (III-1) | 128 | 1.8 | 0.44 | 0.76 | Good |
| Example 2 | (III-2) | 120 | 1.7 | 0.49 | 0.79 | Good |
| Example 3 | (III-3) | 112 | 1.6 | 0.53 | 0.88 | Good |
| Example 4 | (III-4) | 128 | 2.1 | 0.32 | 0.78 | Good |
| Example 5 | (III-5) | 120 | 2.0 | 0.30 | 0.89 | Good |
| Example 6 | (III-6) | 112 | 1.8 | 0.44 | 0.92 | Good |
| Example 7 | (III-7) | 133 | 2.5 | 0.31 | 0.63 | Good |
| Example 8 | (III-8) | 129 | 2.1 | 0.33 | 0.65 | Good |
| Example 9 | (III-9) | 120 | 1.7 | 0.35 | 0.71 | Good |
| Example 10 | (III-10) | 112 | 1.6 | 0.45 | 0.82 | Good |
| Example 11 | (III-11) | 104 | 1.5 | 0.55 | 0.89 | Good |
| Example 12 | (III-12) | 96 | 1.5 | 0.61 | 0.92 | Good |
| Example 13 | (III-13) | 129 | 2.0 | 0.45 | 0.75 | Good |
| Example 14 | (III-14) | 131 | 1.9 | 0.52 | 0.82 | Good |
| Example 15 | (III-15) | 112 | 1.7 | 0.55 | 0.83 | Good |
| Example 16 | (III-16) | 142 | 2.3 | 0.36 | 0.69 | Good |
| Example 17 | (III-17) | 133 | 2.2 | 0.39 | 0.73 | Good |

TABLE 8

| | Resin | Solubility | Compatibility | Charging | $Vk_5$ (%) | $E_{1/2}$ (μJ/cm$^2$) | Vr5 (V) |
|---|---|---|---|---|---|---|---|
| Example 21 | (III-21) | Soluble | Good | Negative | 95 | 0.15 | 29 |
| Example 22 | (III-22) | Soluble | Good | Negative | 94 | 0.16 | 35 |
| Example 23 | (III-23) | Soluble | Good | Negative | 95 | 0.13 | 16 |
| Example 24 | (III-24) | Soluble | Good | Negative | 95 | 0.12 | 14 |
| Example 25 | (III-25) | Soluble | Good | Negative | 95 | 0.13 | 15 |
| Example 26 | (III-1) | Soluble | Good | Negative | 96 | 0.24 | 21 |
| Example 27 | (III-1) | Soluble | Good | Negative | 96 | 0.11 | 11 |
| Example 28 | (III-1) | Soluble | Good | Negative | 96 | 0.13 | 18 |
| Example 29 | (III-1) | Soluble | Good | Negative | 96 | 0.13 | 19 |
| Example 30 | (III-1) | Soluble | Good | Positive | 86 | 0.28 | 25 |
| Example 31 | (III-1) | Soluble | Good | Positive | 83 | 0.20 | 20 |
| Example 32 | (III-1) | Soluble | Good | Positive | 84 | 0.23 | 23 |
| Example 33 | (III-1) | Soluble | Good | Positive | 84 | 0.19 | 20 |

TABLE 9

| | Resin | Bright part potential of actual machine (V) | Amount of wear (μm) | Lubricity Coefficient of dynamic friction Before printing | After printing | Image |
|---|---|---|---|---|---|---|
| Example 21 | (III-21) | −134 | 1.9 | 0.29 | 0.62 | Good |
| Example 22 | (III-22) | −149 | 2.2 | 0.25 | 0.61 | Good |
| Example 23 | (III-23) | −119 | 1.5 | 0.50 | 0.78 | Good |
| Example 24 | (III-24) | −110 | 1.5 | 0.48 | 0.82 | Good |
| Example 25 | (III-25) | −119 | 1.9 | 0.47 | 0.80 | Good |
| Example 26 | (III-1) | −147 | 1.7 | 0.42 | 0.75 | Good |
| Example 27 | (III-1) | −98 | 1.9 | 0.45 | 0.79 | Good |
| Example 28 | (III-1) | −124 | 2.2 | 0.67 | 1.02 | Good |
| Example 29 | (III-1) | −126 | 2.8 | 0.70 | 1.08 | Good |
| Example 30 | (III-1) | 130 | 1.7 | 0.51 | 0.79 | Good |
| Example 31 | (III-1) | 109 | 1.9 | 0.50 | 0.78 | Good |
| Example 32 | (III-1) | 118 | 1.9 | 0.53 | 0.80 | Good |
| Example 33 | (III-1) | 108 | 1.9 | 0.45 | 0.78 | Good |

TABLE 10

| | Resin | Solubility | Compatibility | Charging | $Vk_5$ (%) | $E_{1/2}$ ($\mu J/cm^2$) | Vr5 (V) |
|---|---|---|---|---|---|---|---|
| Comparative Example 1 | (III-26) | Partially insoluble | Phase separation | Negative | 94 | 0.32 | 76 |
| Comparative Example 2 | (III-27) | Partially insoluble | Phase separation | Negative | 94 | 0.38 | 138 |
| Comparative Example 3 | (III-28) | Soluble | Good | Negative | 95 | 0.15 | 20 |
| Comparative Example 4 | (III-29) | Soluble | Good | Negative | 95 | 0.16 | 18 |
| Comparative Example 5 | (III-30) | Soluble | Good | Negative | 95 | 0.16 | 18 |
| Comparative Example 6 | (III-31) | Soluble | Good | Negative | 94 | 0.12 | 19 |
| Comparative Example 7 | (III-32) | Soluble | Good | Negative | 95 | 0.13 | 23 |
| Comparative Example 8 | (III-33) | Soluble | Good | Negative | 92 | 0.16 | 29 |
| Comparative Example 9 | (III-34) | Soluble | Good | Negative | 91 | 0.20 | 35 |
| Comparative Example 10 | (III-31) | Soluble | Good | Positive | 85 | 0.29 | 24 |
| Comparative Example 11 | (III-31) | Soluble | Good | Positive | 85 | 0.28 | 21 |

TABLE 11

| | Resin | Bright part potential of actual machine (V) | Amount of wear (μm) | Lubricity Coefficient of dynamic friction: Before printing | Lubricity Coefficient of dynamic friction: After printing | Image |
|---|---|---|---|---|---|---|
| Comparative Example 1 | (III-26) | −189 | 3.5 | 0.33 | 0.68 | Density decreased |
| Comparative Example 2 | (III-27) | −245 | 4.5 | 0.28 | 0.64 | Density decreased |
| Comparative Example 3 | (III-28) | −123 | 2.5 | 2.85 | 3.10 | Streak-like image defect |
| Comparative Example 4 | (III-29) | −129 | 2.8 | 2.96 | 3.05 | Streak-like image defect |
| Comparative Example 5 | (III-30) | −129 | 2.8 | 2.96 | 3.05 | Streak-like image defect |
| Comparative Example 6 | (III-31) | −128 | 2.7 | 2.85 | 3.11 | Good |
| Comparative Example 7 | (III-32) | −135 | 3.9 | 2.89 | 3.21 | Streak-like image defect |
| Comparative Example 8 | (III-33) | −145 | 3.3 | 1.39 | 2.13 | Streak-like image defect |
| Comparative Example 9 | (III-34) | −139 | 3.2 | 1.59 | 2.34 | Streak-like image defect |
| Comparative Example 10 | (III-31) | 125 | 2.6 | 2.88 | 3.02 | Good |
| Comparative Example 11 | (III-31) | 122 | 2.5 | 2.99 | 3.22 | Good |

As can be seen from the results of Table 6 to 11 shown above, Examples 1 to 33 exhibited low coefficients of friction in the beginning and after printing with an actual machine, and exhibited satisfactory characteristics, without impairing the electrical properties expected from photoreceptors. Furthermore, the amount of wear after printing was also satisfactory as compared with other resins that do not contain any siloxane components. On the other hand, Comparative Examples 1 and 2 have a problem with the solubility of resins and resulted in impaired electrical properties. Furthermore, since Comparative Examples 3 to 5 and 7 do not contain any siloxane components, the coefficients of friction were high, and streak-like image defects occurred in the images after printing. Comparative Examples 6, 10 and 11 had no problem with the electrical properties, but had high coefficients of friction and large amounts of wear. Comparative Examples 8 and 9 had no problem with the electrical properties or the initial coefficient of friction, but the coefficient of friction after printing fluctuated to a large extent. The amount of wear was large, and streak-like image defects were confirmed, which were believed to be attributable to stress relaxation in the film.

As discussed above, it was confirmed that when the copolymerized polyallylate resin according to the present invention was used, an excellent photoreceptor for electrophotography which has a low coefficient of friction and a small amount of wear without impairing electrical properties, can be obtained.

The invention claimed is:

1. A photoreceptor for electrophotography, comprising:

a conductive substrate;

a photosensitive layer provided on the conductive substrate and containing a resin binder that is a copolymerized polyallylate resin represented by a chemical structural formula (1) comprised of structural units (A) and (B), and at least two siloxane structural units (C), (D), (E) and (F) that follow:

(A)

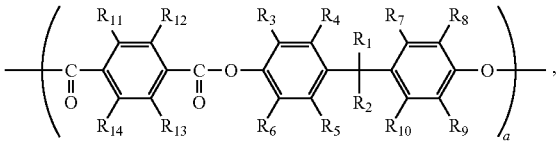

-continued (B)

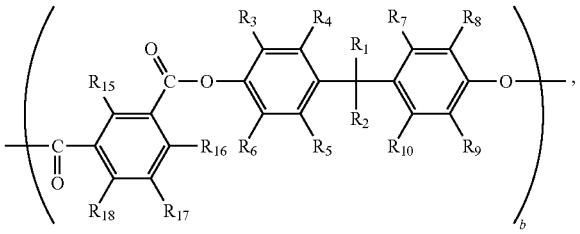

(C)

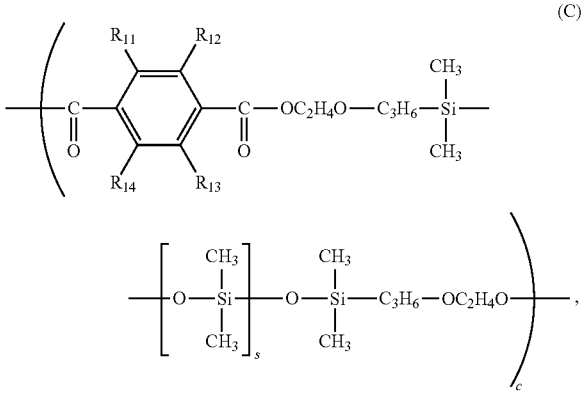

(D)

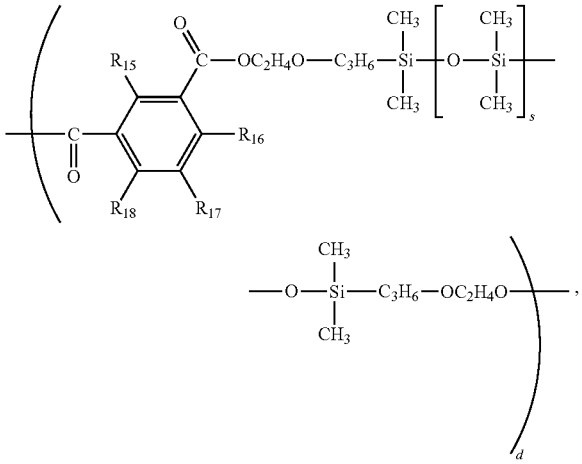

(E)

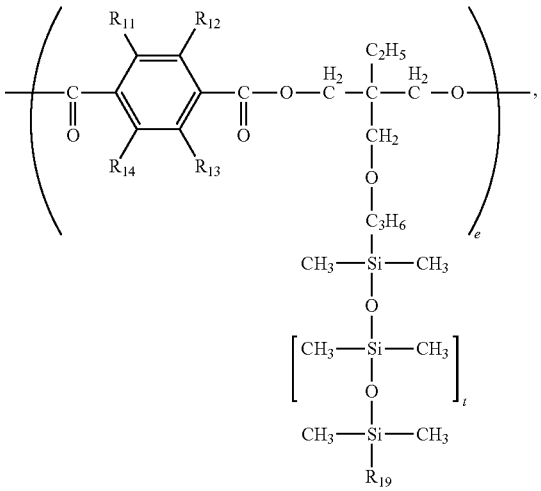

-continued (F)

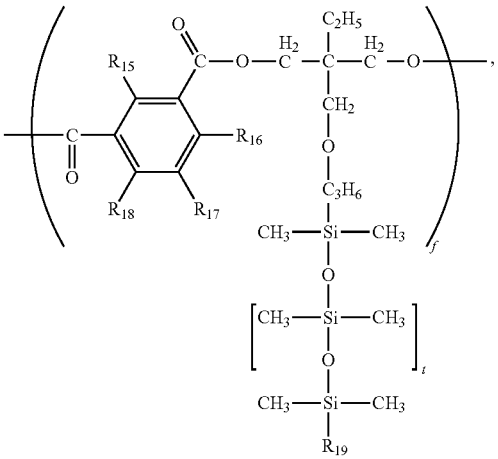

where symbols a, b, c, d, e and f represent molar percentages (mol %) of the structural units (A), (B), (C), (D), (E) and (F), respectively, in the chemical structural formula (1) with the sum (a+b+c+d+e+f) being 100 mol %; $R_1$ and $R_2$, which may be identical or different, each represent a hydrogen atom, an alkyl group having 1 to 8 carbon atoms, a cycloalkyl group which may be substituted, or an aryl group which may be substituted, or $R_1$ and $R_2$ may form a cyclic structure together with the carbon atom to which $R_1$ and $R_2$ are bonded, while the cyclic structure may have one or two arylene groups bonded thereto; $R_3$ to $R_{18}$, which may be identical or different, each represent a hydrogen atom, an alkyl group having 1 to 8 carbon atoms, a fluorine atom, a chlorine atom, or a bromine atom; $R_{19}$ represents a hydrogen atom, an alkyl group having 1 to 20 carbon atoms, an alkylene group having 1 to 20 carbon atoms, an aryl group which may be substituted, a cycloalkyl group which may be substituted, a fluorine atom, a chlorine atom, or a bromine atom; and symbols s and t each represent an integer of 1 or greater.

2. An electrophotographic apparatus onto which is mounted the photoreceptor for electrophotography according to claim 1.

3. The photoreceptor for electrophotography according to claim 1, wherein c and d in the chemical structural formula (1) each represents 0 mol %.

4. The photoreceptor for electrophotography according to claim 3, wherein chemical structural formula (1) satisfies the following expression:

$$0.001 \leq c+d+e+f \leq 10.$$

5. An electrophotographic apparatus onto which is mounted the photoreceptor for electrophotography according to claim 4.

6. An electrophotographic apparatus onto which is mounted the photoreceptor for electrophotography according to claim 3.

7. The photoreceptor for electrophotography according to claim 1, wherein e and f in the chemical structural formula (1) each represents 0 mol %.

8. The photoreceptor for electrophotography according to claim 7, wherein chemical structural formula (1) satisfies the following expression:

$$0.001 \leq c+d+e+f \leq 10.$$

9. An electrophotographic apparatus onto which is mounted the photoreceptor for electrophotography according to claim 8.

10. An electrophotographic apparatus onto which is mounted the photoreceptor for electrophotography according to claim 7.

11. The photoreceptor for electrophotography according to claim 1, wherein chemical structural formula (1) satisfies the following expression:

$$0.001 \leq c+d+e+f \leq 10.$$

12. An electrophotographic apparatus onto which is mounted the photoreceptor for electrophotography according to claim 11.

13. The photoreceptor for electrophotography according to claim 1, wherein, in the chemical structural formula (1), $R_1$ and $R_2$ each are methyl groups, and $R_3$ to $R_{18}$ each are a hydrogen atom.

14. An electrophotographic apparatus onto which is mounted the photoreceptor for electrophotography according to claim 13.

15. The photoreceptor for electrophotography according to claim 1, wherein the photosensitive layer includes at least a charge generation layer and a charge transport layer, and the charge transport layer contains the copolymerized polyallylate resin and a charge transporting material.

16. An electrophotographic apparatus onto which is mounted the photoreceptor for electrophotography according to claim 15.

17. The photoreceptor for electrophotography according to claim 15, wherein the charge generation layer and the charge transport layer are laminated in this order on the conductive substrate.

18. The photoreceptor for electrophotography according to claim 1, wherein the photosensitive layer contains the copolymerized polyallylate resin, a charge generating material and a charge transporting material.

19. An electrophotographic apparatus onto which is mounted the photoreceptor for electrophotography according to claim 18.

20. The photoreceptor for electrophotography according to claim 1, wherein the photosensitive layer includes at least a charge transport layer and a charge generation layer, and the charge generation layer contains the copolymerized polyallylate resin, a charge generating material, and a charge transporting material.

21. An electrophotographic apparatus onto which is mounted the photoreceptor for electrophotography according to claim 20.

22. The photoreceptor for electrophotography according to claim 20, wherein the charge transport layer and the charge generation layer are laminated in this order on the conductive substrate.

23. The photoreceptor for electrophotography according to claim 20, wherein the charge transporting material contains a hole transporting material and an electron transporting material.

24. A process for producing a photoreceptor for electrophotography, comprising the steps of:

applying a coating liquid containing at least a resin binder onto a conductive substrate to form a photosensitive layer on the conductive substrate, wherein the coating liquid contains a resin binder that is a copolymerized polyallylate resin represented by a chemical structural formula (1) comprised of structural units (A) and (B), and at least two siloxane structural units (C), (D), (E) and (F) that follow:

(A)

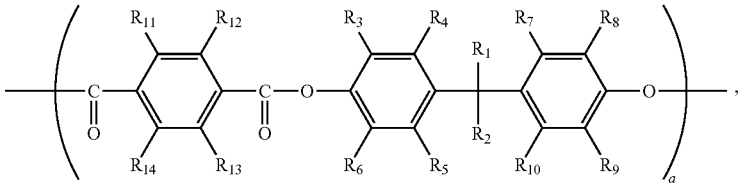

(B)

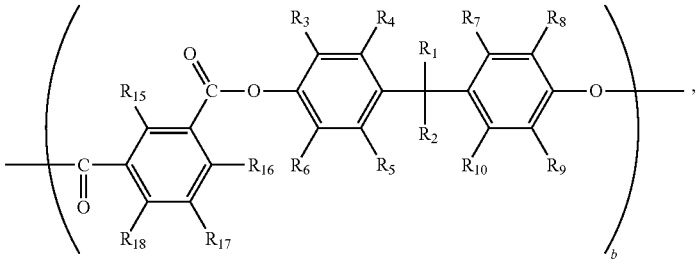

(C)

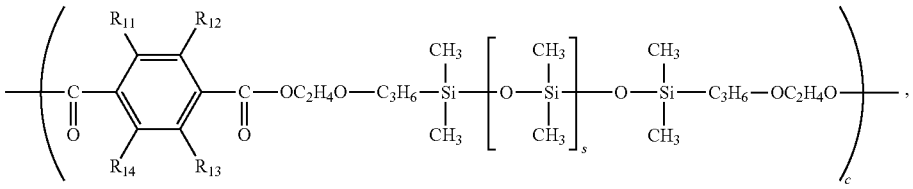

-continued (D)

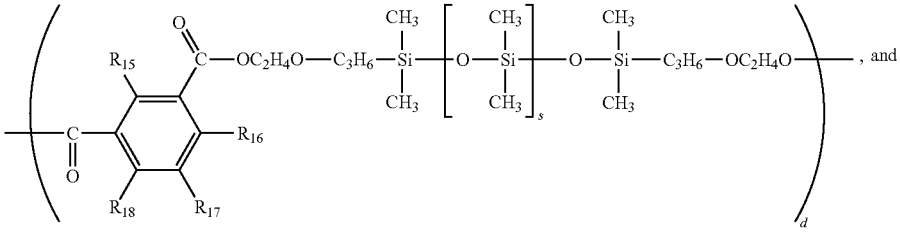

, and (F)

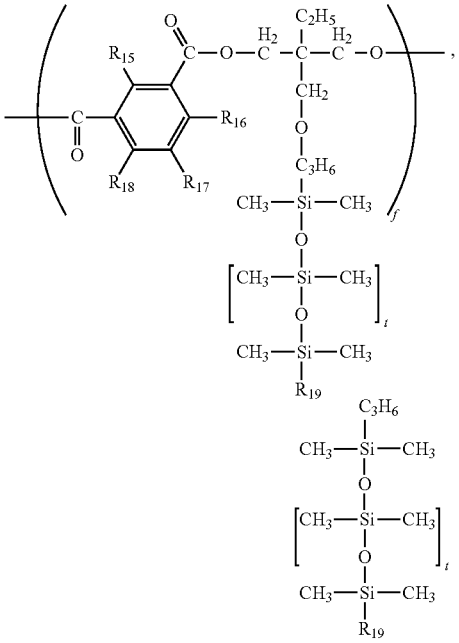

where symbols a, b, c, d, e and f represent molar percentages (mol %) of the structural units (A), (B), (C), (D), (E) and (F), respectively, in the chemical structural formula (1) with the sum (a+b+c+d+e+f) being 100 mol %; $R_1$ and $R_2$, which may be identical or different, each represent a hydrogen atom, an alkyl group having 1 to 8 carbon atoms, a cycloalkyl group which may be substituted, or an aryl group which may be substituted, or $R_1$ and $R_2$ may form a cyclic structure together with the carbon atom to which $R_1$ and $R_2$ are bonded, while the cyclic structure may have one or two arylene groups bonded thereto; $R_3$ to $R_{18}$, which may be identical or different, each represent a hydrogen atom, an alkyl group having 1 to 8 carbon atoms, a fluorine atom, a chlorine atom, or a bromine atom; $R_{19}$ represents a hydrogen atom, an alkyl group having 1 to 20 carbon atoms, an alkylene group having 1 to 20 carbon atoms, an aryl group which may be substituted, a cycloalkyl group which may be substituted, a fluorine atom, a chlorine atom, or a bromine atom; and symbols s and t each represent an integer of 1 or greater.

* * * * *